US007429037B2

(12) United States Patent
Kawata et al.

(10) Patent No.: US 7,429,037 B2
(45) Date of Patent: Sep. 30, 2008

(54) SHEET PROCESSING APPARATUS AND IMAGE FORMING APPARATUS EQUIPPED WITH THE SAME

(75) Inventors: Wataru Kawata, Kashiwa (JP); Taro Ikeda, Tokyo (JP); Hiroaki Takagishi, Tokyo (JP); Kenichi Hayashi, Abiko (JP); Tomokazu Nakamura, Matsudo (JP); Hideki Kushida, Moriya (JP); Hiromasa Katayama, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 294 days.

(21) Appl. No.: 11/180,555

(22) Filed: Jul. 14, 2005

(65) Prior Publication Data

US 2006/0017218 A1 Jan. 26, 2006

(30) Foreign Application Priority Data

Jul. 20, 2004 (JP) ..... 2004-211808

(51) Int. Cl.
*B65H 37/04* (2006.01)

(52) U.S. Cl. ..... 270/37; 270/32; 270/58.07; 270/58.08; 270/58.11; 270/58.12

(58) Field of Classification Search ..... 270/37, 270/58.07, 58.08, 58.09, 58.11, 58.12
See application file for complete search history.

(56) References Cited

U.S. PATENT DOCUMENTS

| | | | | |
|---|---|---|---|---|
| 5,897,250 | A | 4/1999 | Hirai et al. | 399/404 |
| 6,022,011 | A * | 2/2000 | Hirose | 270/37 |
| 6,241,234 | B1 | 6/2001 | Saitoh et al. | 270/58.12 |
| 6,251,054 | B1 * | 6/2001 | Cruz et al. | 493/383 |
| 6,264,189 | B1 | 7/2001 | Kawata | 271/176 |
| 6,264,194 | B1 | 7/2001 | Hayashi et al. | 271/220 |
| 6,290,220 | B1 | 9/2001 | Takehara et al. | 270/58.12 |
| 6,505,829 | B2 | 1/2003 | Kawata | 271/208 |
| 6,575,446 | B2 * | 6/2003 | Wakabayashi et al. | 270/58.07 |
| 6,824,128 | B2 | 11/2004 | Nagata et al. | 270/58.08 |
| 6,908,078 | B2 | 6/2005 | Suzuki et al. | 270/15 |

(Continued)

FOREIGN PATENT DOCUMENTS

JP 11-322171 11/1999

OTHER PUBLICATIONS

Official Letter/Search Report, issued by the Chinese State Intellectual Property Office (SIPO), on Apr. 4, 2008, in Chinese Patent Application No. 200510085044.X, and translation.

*Primary Examiner*—Gene O. Crawford
*Assistant Examiner*—Leslie A Nicholson, III
(74) *Attorney, Agent, or Firm*—Fitzpatrick, Cella, Harper & Scinto

(57) ABSTRACT

The sheet processing apparatus is equipped with a process tray on which sheets conveyed are stacked, a return belt which moves the sheets stacked on the process tray, a trailing edge stopper which receives an end portion of the sheets moved by the return belt, and a conveyance assist roller which comes into contact with the sheets on the upstream side of the return belt with respect to the sheet moving direction and imparts a load to the movement of the sheets. The return belt moves the sheets to which a load has been imparted by the conveyance assist roller and causes them to be abutted on the trailing edge stopper.

13 Claims, 15 Drawing Sheets

U.S. PATENT DOCUMENTS

| | | | | |
|---|---|---|---|---|
| 6,976,672 | B2 | 12/2005 | Kawata | 271/9.11 |
| 7,011,306 | B2 | 3/2006 | Kato et al. | 271/256 |
| 7,080,830 | B2 | 7/2006 | Suzuki et al. | 270/58.08 |
| 2002/0050681 | A1* | 5/2002 | Hosaka | 271/207 |
| 2002/0163119 | A1* | 11/2002 | Kawata | 271/207 |
| 2004/0113348 | A1* | 6/2004 | Awano | 270/58.07 |
| 2005/0082734 | A1 | 4/2005 | Goto et al. | 271/1 |
| 2005/0082735 | A1 | 4/2005 | Nakamura et al. | 271/1 |
| 2005/0084308 | A1 | 4/2005 | Nakamura et al. | 399/407 |
| 2006/0017209 | A1 | 1/2006 | Kushida et al. | 270/37 |
| 2006/0017218 | A1 | 1/2006 | Kawata et al. | 271/207 |
| 2006/0018694 | A1 | 1/2006 | Hayashi | 399/406 |
| 2006/0019811 | A1 | 1/2006 | Ikeda et al. | 493/444 |
| 2006/0061031 | A1 | 3/2006 | Kawata | 271/9.11 |

* cited by examiner

SHEET PROCESSING APPARATUS AND IMAGE FORMING APPARATUS EQUIPPED WITH THE SAME

BACKGROUND OF THE INVENTION

1. Field of the Invention

The present invention relates to a sheet processing apparatus for performing process on sheets and, in particular, a sheet processing apparatus for performing process on sheets with substantially no slack generated therein, and to an image forming apparatus whose apparatus main body is equipped with this sheet processing apparatus.

2. Related Background Art

For example, a conventional sheet processing apparatus staples sheets stacked together. As disclosed, for example, in Japanese Patent Laid-Open No. 11-322171, such a sheet processing apparatus may be provided in the main body of an image forming apparatus as a component of the image forming apparatus. Examples of the image forming apparatus include a copying machine, a printing apparatus, a laser beam printer, and a composite apparatus composed of these apparatuses.

FIG. 15 shows a conventional sheet processing apparatus 901, which performs alignment process for aligning an end portion of a sheet stack, a side stitch binding process for stapling an end portion of a sheet stack, a saddle stitch binding process for stapling the center or a portion near the center of a sheet stack to form a two-folded booklet, etc.

That is, the conventional sheet processing apparatus 901 successively receives sheets P with images formed on one side or both sides thereof in an apparatus main body 903 of an image forming apparatus 902, and while doing so, aligns the sheet widths (i.e., performs width alignment) to form a stack by a width alignment device 907. Thereafter, the sheet processing apparatus 901 staples an end portion of the sheet stack by an end portion stapler unit 908, and discharges the stack onto a sheet stacking portion 904 by a discharge roller pair 909. In this way, the conventional sheet processing apparatus 901 shown in FIG. 15 is capable of stapling an end portion of a sheet stack.

Further, the conventional sheet processing apparatus 901 stacks sheets successively received from the apparatus main body 903 of the image forming apparatus 902 on a steep, substantially straight saddle stitch process tray 910, and receives them by a stopper 911 to form a stack. Then, the sheet processing apparatus 901 performs width alignment on the sheets P by a width alignment device (not shown), and then staples two portions of the sheet stack near the center thereof by an intermediate portion stapler unit 912. Thereafter, the sheet processing apparatus 901 moves the stopper 911, and causes the stapled portion of the sheet stack to be opposed to the nip of a sheet folding roller pair 914 and a sheet pushing plate 913. And, the sheet processing apparatus,901 pushes the stapled portion of the sheet stack by the sheet pushing plate 913 to send the sheet stack to the nip of the sheet folding roller pair 914, and folds the sheet stack into two while nipping and conveying it by the sheet folding roller pair 914. Finally, the sheet processing apparatus 901 discharges the stack onto a sheet stacking portion 905 by a discharge roller pair 915. In this way, the conventional sheet processing apparatus 901 shown in FIG. 15 is also capable of forming a sheet stack into a twofold booklet.

Incidentally, to achieve space saving and meet various requirements of the users, there recently is a tendency for office machines to be reduced in installation area and to be increased in versatility. Similarly, sheet processing apparatuses also used as office machines also tend to be reduced in installation area and to be increased in versatility. Thus, even if a reduction in installation area and an increase in versatility are achieved through changing of the arrangement positions of the end portion stapler unit 908, the intermediate portion stapler unit 912, etc. it is necessary to align an end portion of a sheet stack when performing sheet alignment process, side stitching process, saddle stitching process, etc.

It should be noted, however, that when aligning sheets, the sheets may be swollen to generate slack when the sheets are abutted on the stopper 911. When such slack is generated, the end portion of the sheet stack becomes uneven, with the result that the alignment property deteriorates, making it impossible to accurately perform sheet alignment process, side stitch process, saddle stitch process, etc.

SUMMARY OF THE INVENTION

It is an object of the present invention to provide a sheet processing apparatus in which sheets are abutted on stopper means with substantially no slack generated in the sheets to thereby achieve an improvement in terms of sheet alignment property.

To attain the above object, a sheet processing apparatus according to the present invention includes a stacking portion which receives sheets that are conveyed; a moving unit which moves the sheets conveyed to the stacking portion; a stopper which receives an end portion of the sheets moved by the moving unit; and a load imparting portion which comes into contact with the sheets on the upstream side of the moving unit with respect to the sheet moving direction and imparts a load to the movement of the sheets. The moving unit moves the sheets to which a load has been imparted by the load imparting portion to be abutted on the stopper.

In the sheet processing apparatus of the present invention, the moving unit moves sheets to which a load is imparted by the load imparting portion to the stopper to cause them to be abutted thereon, so that the sheets are abutted on the stopper while involving substantially no slack with the sheets stretched by the load of the load imparting portion, thereby achieving an improvement in terms of sheet end alignment property.

DESCRIPTION OF THE PREFERRED EMBODIMENTS

In the following, image forming apparatuses and sheet processing apparatuses according to embodiments of the present invention will be described with reference to the drawings.

(Image Forming Apparatus)

Figure 1:
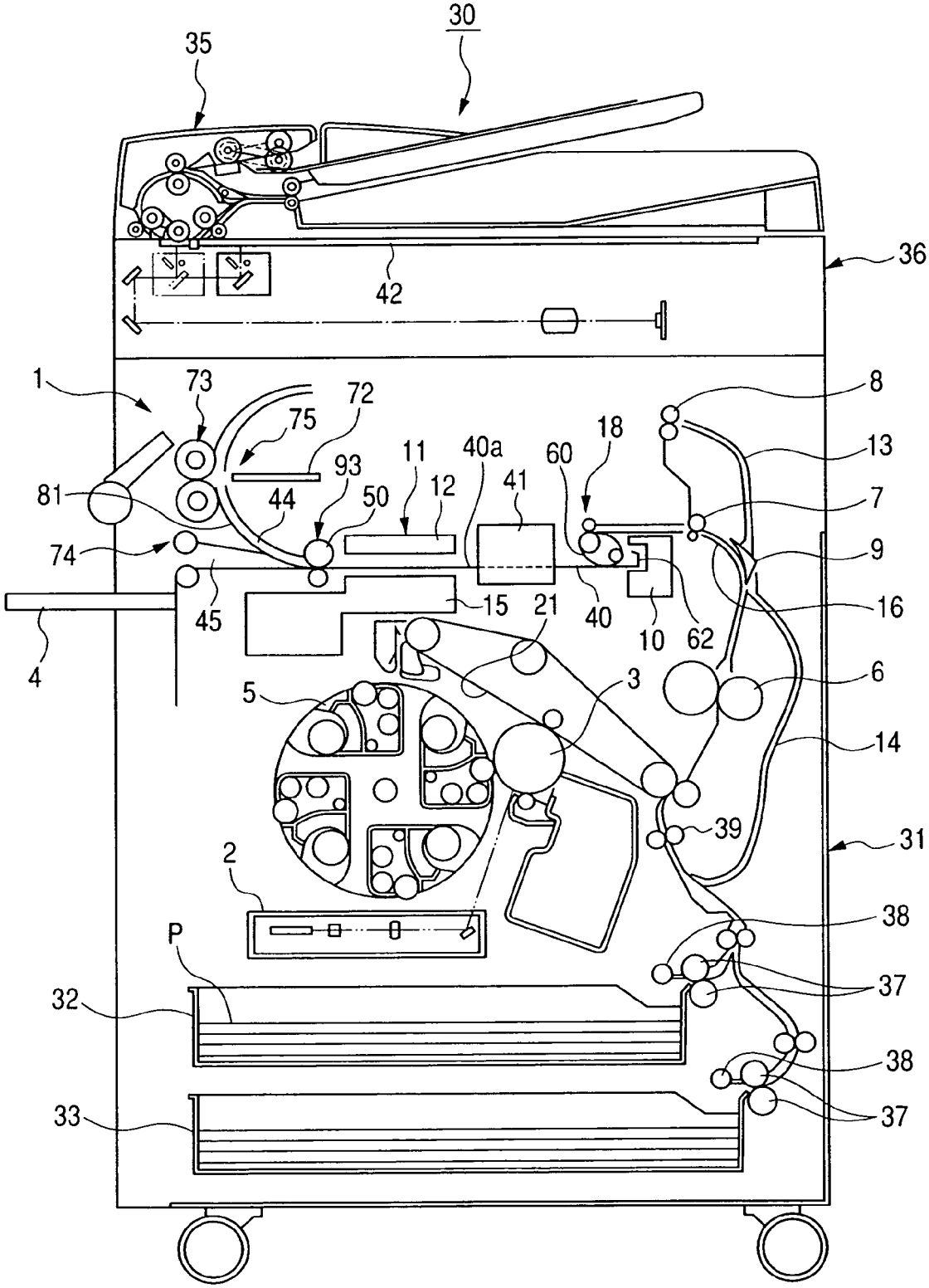
FIG. 1 is a schematic front sectional view of a color copying machine as an image forming apparatus according to an embodiment of the present invention.

A color copying machine as an image forming apparatus will be described with reference to FIG. 1. Examples of an image forming apparatus include a copying machine, a printing apparatus, a laser beam printer, and a composite apparatus composed of these apparatuses. The image forming apparatus of this embodiment of the present invention consists of a multi-color copying machine, which should not be construed as restrictively.

A color copying machine 30 is formed by successively stacking from below the following components: an apparatus main body 31, a sheet processing apparatus 1, an image reading apparatus 36, and an original feeding apparatus 35. The original feeding apparatus 35 feeds an original automatically to the image reading apparatus 36. The image reading apparatus 36 as a reading means is adapted to read an original fed by the original feeding apparatus 35, or an original placed on an original glass table 42 by the user, with the original feeding apparatus 35 being rearwardly open. It is not always necessary to provide the image reading apparatus 36. Further, if the image reading apparatus 36 is provided, it is not always necessary to provide the original feeding apparatus 35. Further, it should be noted that the color copying machine 30 is a so-called in-body discharge type, in which a sheet is discharged into the sheet processing apparatus 1 provided between the apparatus main body 31 and the image reading apparatus 36. The sheet processing apparatus 1 may be detachable.

The operation of the color copying machine will be described. The original feeding apparatus 35 feeds an original automatically to the reading position of the image reading apparatus 36. The image reading apparatus 36 reads the image of the original. A controller (not shown) supplies a signal to a laser scanner unit 2 based on the image information read by the image reading apparatus 36. The laser scanner unit 2 applies a laser beam to a photosensitive drum 3 as an image forming means whose surface is uniformly charged. The image information signal received by the laser scanner unit 2 may be an image information signal supplied from an external personal computer. Further, also when no image reading apparatus 36 is provided, the laser scanner unit 2 applies a laser beam to the photosensitive drum 3 based on an image signal supplied from outside.

An electrostatic latent image on the photosensitive drum 3 is developed with toner by a developing device 5, and is turned into a toner image. The toner image is transferred to a transfer belt 21, and then transferred to a sheet P consisting of a paper sheet, an OHP sheet or the like.

Sheets P are conveyed selectively from sheet cassettes 32 and 33 as appropriate by pickup rollers 38, and are separated from each other by separation roller pairs 37 before being fed to a registration roller pair 39. After correction for skew feed by the registration roller pair 39, each sheet P is sent to a transfer position in synchronization with the rotation and running of the photosensitive drum 3 and the transfer belt 21. As a result, the toner image on the transfer belt 21 is transferred to the sheet P.

Thereafter, the sheet P is guided to a fixing roller pair 6, where it is heated and pressurized by the fixing roller pair 6 to thereby permanently fix the toner image thereto. The fixing roller pair 6 are respectively in contact with an upper fixing-separation claw and a lower fixing-separation claw, and the sheet P is separated from the fixing roller pair 6 by these claws.

In the case of one-side printing, the separated sheet P is sent to the sheet processing apparatus 1 from the apparatus main body 31 of the color copying machine 30 by a first discharge roller pair 7. In the case of two-side printing, the separated sheet P is guided to a conveying path 13 by a direction switching flapper 9, and its leading edge portion is discharged to the exterior of the apparatus main body 31 by a, second discharge roller pair 8. When the trailing edge portion of the sheet P passes the direction switching flapper 9, the second discharge roller pairs 8 are reversed, and the sheet P is guided to a conveyance path 14 by the direction switching flapper 9. As a result, the sheet P is reversed, and sent to the transfer belt 21 again, where the toner image is transferred to the rear surface of the sheet. Thereafter, the sheet P undergoes heating/pressurizing process by the fixing roller pair 6 to have the toner image fixed thereto, and is then sent from the apparatus main body 31 to the sheet processing apparatus 1 by way of a conveyance path 16 by the first discharge roller pair 7.

(Sheet Processing Apparatus)

The sheet processing apparatus will be described with reference to FIGS. 1 through 12. While the sheet processing apparatus of this embodiment is incorporated into a color copying machine, it may also be incorporated into a printing apparatus, a laser beam printer or the like. The apparatus into which the sheet processing apparatus of this embodiment is to be incorporated is not restricted to a color copying machine.

The sheet processing apparatus 1 is adapted to perform alignment process (sorting process) for aligning in a stack the sheets conveyed from the apparatus main body 31 of the color copying machine 30, side stitch binding process (staple sorting process) for stapling an end portion of the sheet stack by an end stapler 10, and saddle stitch binding process (saddle stitch process) for stapling the center and a portion near the center of the sheet stack by an intermediate portion stapler 11 and then folding the sheet stack into two by a folding device 75 to form a booklet.

Figure 2:
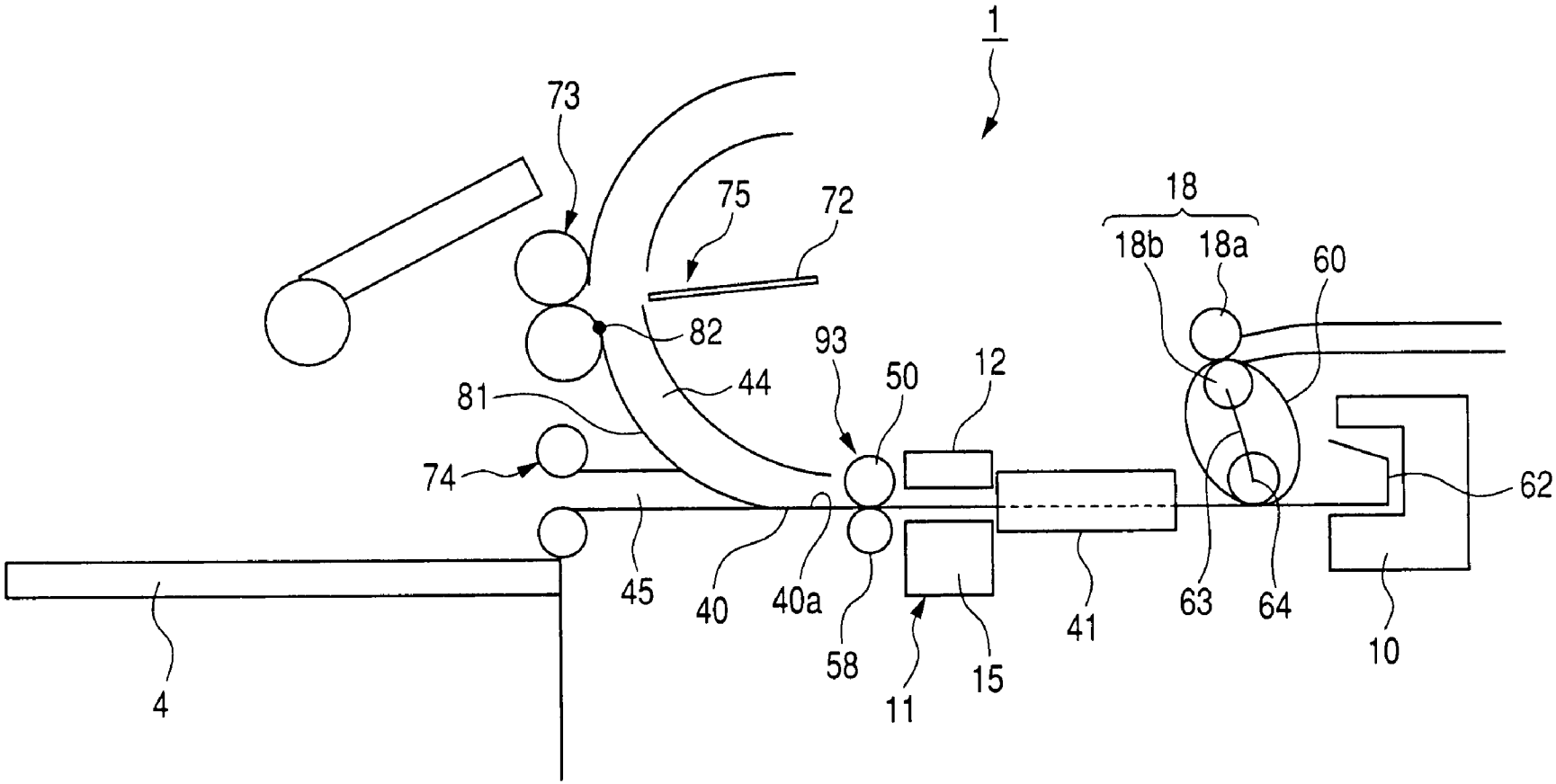
FIG. 2 is a schematic front sectional view of a sheet processing apparatus according to an embodiment of the present invention.

In FIG. 2, the sheet processing apparatus 1 is equipped with a process tray 40 as a stacking means on which the sheets conveyed are stacked, a return belt 60 as a moving means for moving the sheets stacked on the process tray 40, a trailing edge stopper 62 as stopper means for receiving the end portions of the sheets moved by the return belt 60, and a conveyance roller pair 93 which are a rotary member pair constituting a load imparting means adapted to come into contact with the sheets on the upstream side (the left-hand side in FIG. 2) of the return belt 60 with respect to the sheet moving direction and to impart a load to the movement of the sheets. The return belt 60 is adapted to move the sheets to which a load has been imparted by the conveyance roller pair 93 to the trailing edge stopper 62 to abut them thereon. The load imparting means, or the rotary member pair, may also be a belt pair consisting of two circulating-belts. Thus, the load imparting means, or the rotary member pair, is not restricted to a roller pair.

In the sheet processing apparatus 1 of this embodiment, there are three cases: a case in which the sheets P discharged from the first discharge roller pair 7 of the color copying machine 30 are formed into a stack on the process tray 40 and are discharged onto a stack tray 4 as they are; a case in which an end portion of the sheet stack is stapled by the end stapler 10 as the end stapling means and discharged onto the stack tray 4; and a case in which stapling is effected on a sheet stack by the intermediate portion stapler 11 as an intermediate portion stapling means for stapling the center of the sheet stack and folding it into two on a sheet pushing plate 72 and a sheet folding roller pair 73 to make a booklet before discharging it onto the stack tray 4.

Thus, the sheet processing apparatus 1 is equipped with a linear path 85 for guiding a sheet stack that has undergone stapling by the end stapler 10 or a sheet stack that has undergone no stapling, and a curved path 44 as a curved guide path for guiding a sheet stack that has undergone stapling by the intermediate portion stapler 11 to the folding device 75. The curved path 44 branches off from a linear path 43, and is curved so as to extend away from the linear path 43. While the curved path 44 of this embodiment is upwardly curved, it may also be downwardly curved. That is, it is only necessary for the curved path 44 to be curved in the sheet thickness direction. The folding device 75 as the folding means is equipped with the sheet pushing plate 72 as an abutment member, the sheet folding roller pair 73 as the folding portion, etc.

(Illustration of the Operation of the Sheet Processing Apparatus)

(Illustration of the Operation of the Staple Sorting Process)

Figure 3A:
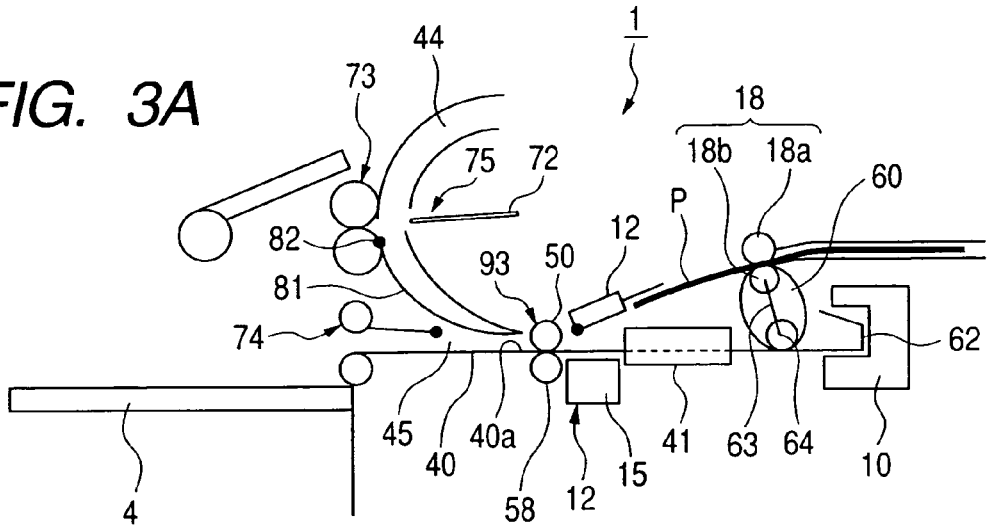
FIG. 3A is a diagram for illustrating the operation of side stitch binding process (staple sorting process) of the sheet processing apparatus of the embodiment of the present invention for stapling a sheet stack end portion, showing how a sheet is conveyed to the sheet processing apparatus.

The operation of the staple sorting process will be described with reference to FIGS. 1 through 6. When a staple sorting process mode is selected, the sheet processing apparatus 1 moves, as shown in FIG. 3A, an anvil 12 of the intermediate portion stapler (saddle stitch stapler) 11 and a curved outer guide 81 constituting the curved path 44, upwardly, before the sheets P are discharged from the first discharge roller pair 7 of the color copying machine 30. Further, a pair of-discharge rollers 74 are opened. Further, a conveyance assist roller 50 is lightly brought into contact with a driven roller 58 to close the conveyance roller pair 93. Further, the sheet processing apparatus 1 holds the trailing edge stopper 62 for regulating the trailing edges of the sheets on standby at a home position which is the stapling position for the sorted sheets (FIG. 6 (S101)).

Here, a judgment is made as to whether the initial state of the staple sorting process has been completed or not (S102). That is, a judgment is made as to whether the anvil 12 is at the raised position, whether the curved guide 81 is at the raised position, whether the conveyance assist roller 50 is at the light pressure position, whether the conveyance roller pair 74 is open, and whether the trailing edge stopper 62 is at the home position (S102).

Figure 3B:
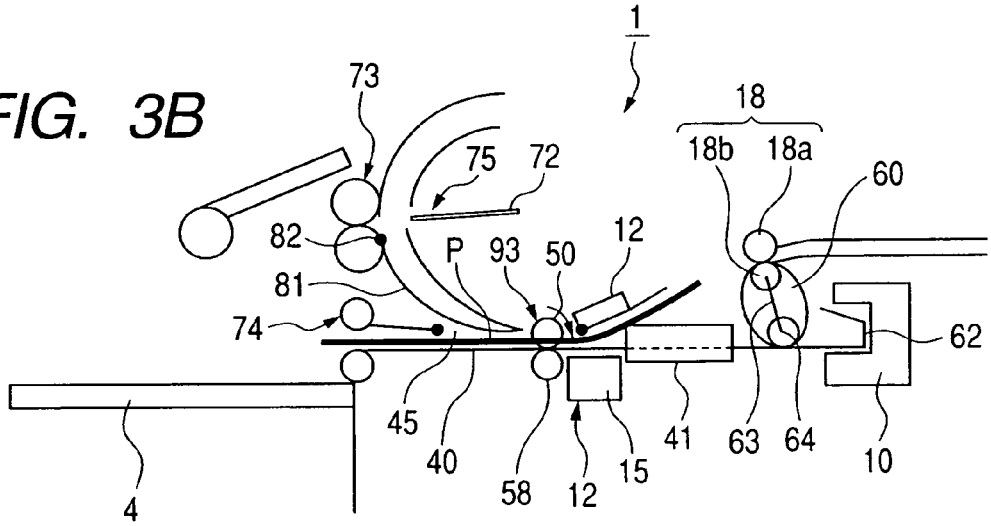
FIG. 3B is a diagram showing how the sheet is sent to a process tray.

As shown in FIG. 3B, the sheets P fed into the sheet processing apparatus 1 are discharged onto the sheet stacking surface 40*a* of the process tray 40 by a sheet discharge roller pair 18 composed of a driving roller 18*b* and a driven roller 18*a* driven to be rotated thereby. The sheet stacking surface 40*a* is formed as a flat surface.

In order to secure the requisite time for aligning the sheets P on the process tray 40, the sheet conveying speed (V1) at which the conveyance assist roller 50 discharges the sheets P onto the process tray 40 is made higher than the sheet conveying speed (V2) of the first discharge roller pair 7 (V2>V1). Thus, the conveyance assist roller 50 is abutted with light pressure on the sheets discharged from the first discharge roller pair 7 and draws the sheets onto the process tray 40 while making slip rotation, so that it is possible to discharge the sheets onto the process tray 40 while involving no buckling in the sheets between it and the first discharge roller pair 7. Thus, the sheet process apparatus 1 can stack the sheets in a flat state on the process tray 40, making it possible to enhance the sheet alignment property for the subsequent sheet alignment operation.

As shown in FIG. 3B, the discharged sheets P are guided by the anvil 12 and are conveyed by the conveyance assist roller 50 until they are spaced downstream from the sorting discharge roller pair 18 by a predetermined distance (for example, approximately 20 mm). Thereafter, the sheet processing apparatus 1 stops and reverses (rotates counterclockwise) the conveyance assist roller 50 to convey the sheet P toward the return belt 60. When the trailing edge (the right-hand end in FIGS. 3A, 3B and 3C) of the sheets P reach the return belt 60 (FIG. 3C), the conveyance assist roller 50 starts to rotate clockwise to transmit to the sheets a sheet conveying force for moving the sheets P to the downstream side (toward the discharge roller pair 74) (FIG. 4A).

At this time, the sheet conveying force (moving force F1) of the conveyance assist roller 50 is set to be less than the sheet conveying force (moving force F2) of the return belt 60 (F1<F2). Thus, the return belt 60 moves the sheets to the trailing edge stopper 62 side against the load of the conveyance assist roller 50. Thus, the sheets are pulled away from the trailing edge stopper 62 by the conveyance assist roller 50 and generate no slack, and are moved to the trailing edge stopper 62 side by the return belt 60 to be abutted on the trailing edge stopper 62.

Further, the difference between the sheet conveying force of the return belt 60 and the sheet conveying force of the conveyance assist roller 50 is set to such a magnitude as will involve no buckling when the sheets P are pressed against the trailing edge stopper 62. Thus, the sheet processing apparatus 1 causes the sheets to be abutted on the trailing edge stopper 62 without involving any slack or buckling of the sheets, so that it is possible to enhance the alignment property for the trailing edges of the sheets.

The sheet processing apparatus 1 causes the sheets to be abutted on the trailing edge stopper 62 by the return belt 60 to effect alignment on the end portion crossing the conveying direction of the sheets P, and then effects alignment on a side edge extending in the conveying direction for the sheets P (width alignment). That is, after conveying the sheets P by a predetermined amount from the discharge roller pair 8, the conveyance assist roller 50 is reversed; further, after conveying the sheets P by a predetermined amount from the return belt 60, the conveyance assist roller 50 is rotated in the normal direction, effecting alignment on the sheets P by a pair of alignment plates 41 as a side edge aligning means (FIG. 6 (S103)). The pair of alignment plates 41 are adapted to be operated by a driving means (not shown) (e.g., a drive source consisting of rack and pinion gear and a control means). This makes it possible to enhance the alignment property for the sheet side edges.

Figure 4A:
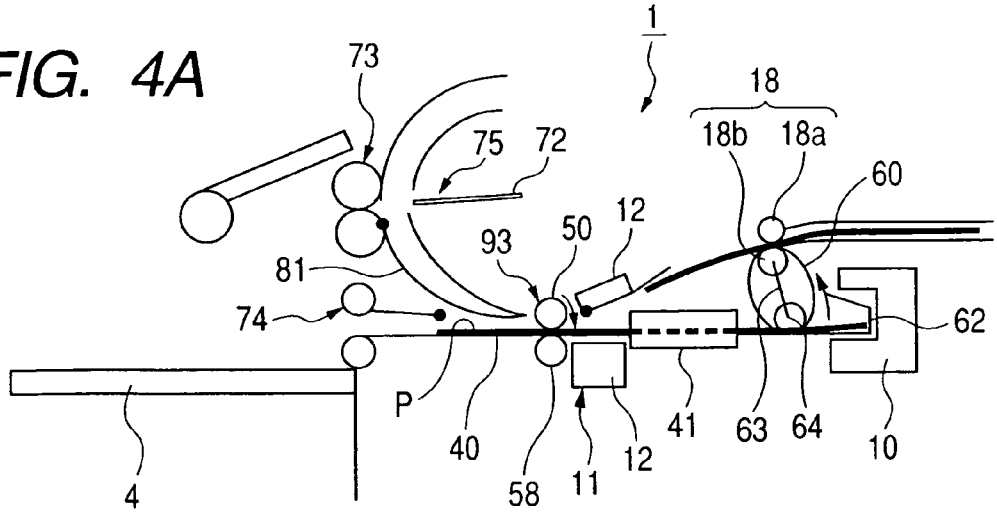
FIG. 4A is a diagram for illustrating the side stitch binding process operation as continued from FIGS. 3A through 3C, showing how the sheet on the process tray is abutted on the stopper.
Figure 4B:
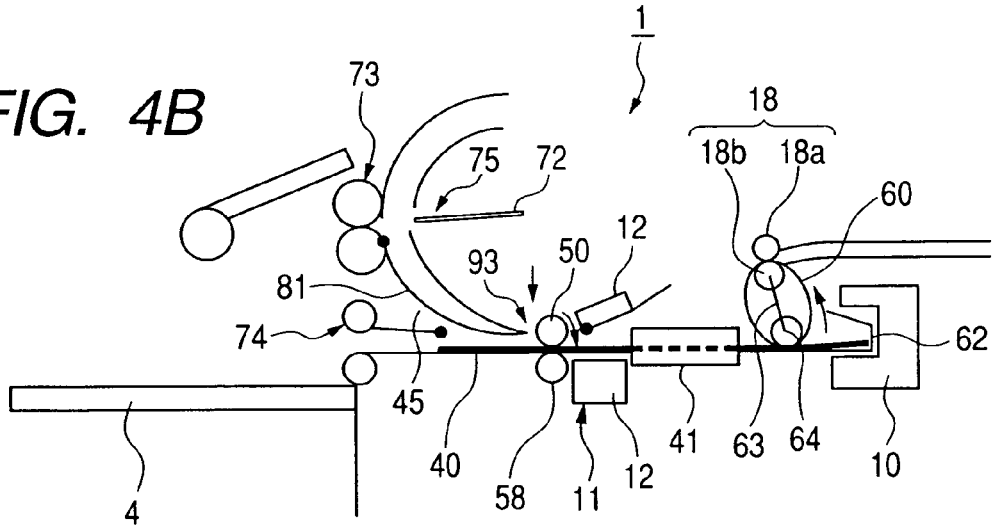
FIG. 4B is a diagram showing how a predetermined number of sheets are stacked on the process tray.
Figure 4C:
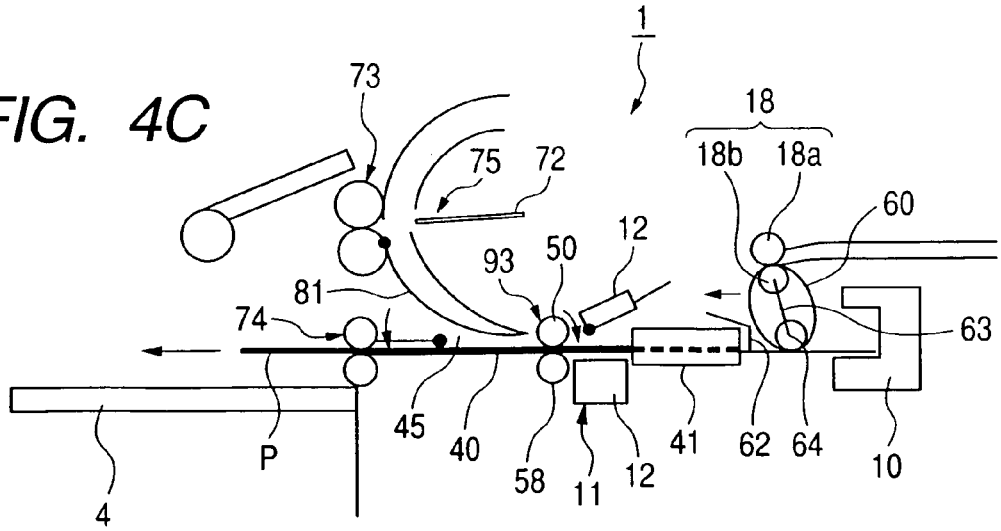
FIG. 4C is a diagram showing how a sheet stack with an end portion thereof stapled is discharged.
Figure 6:
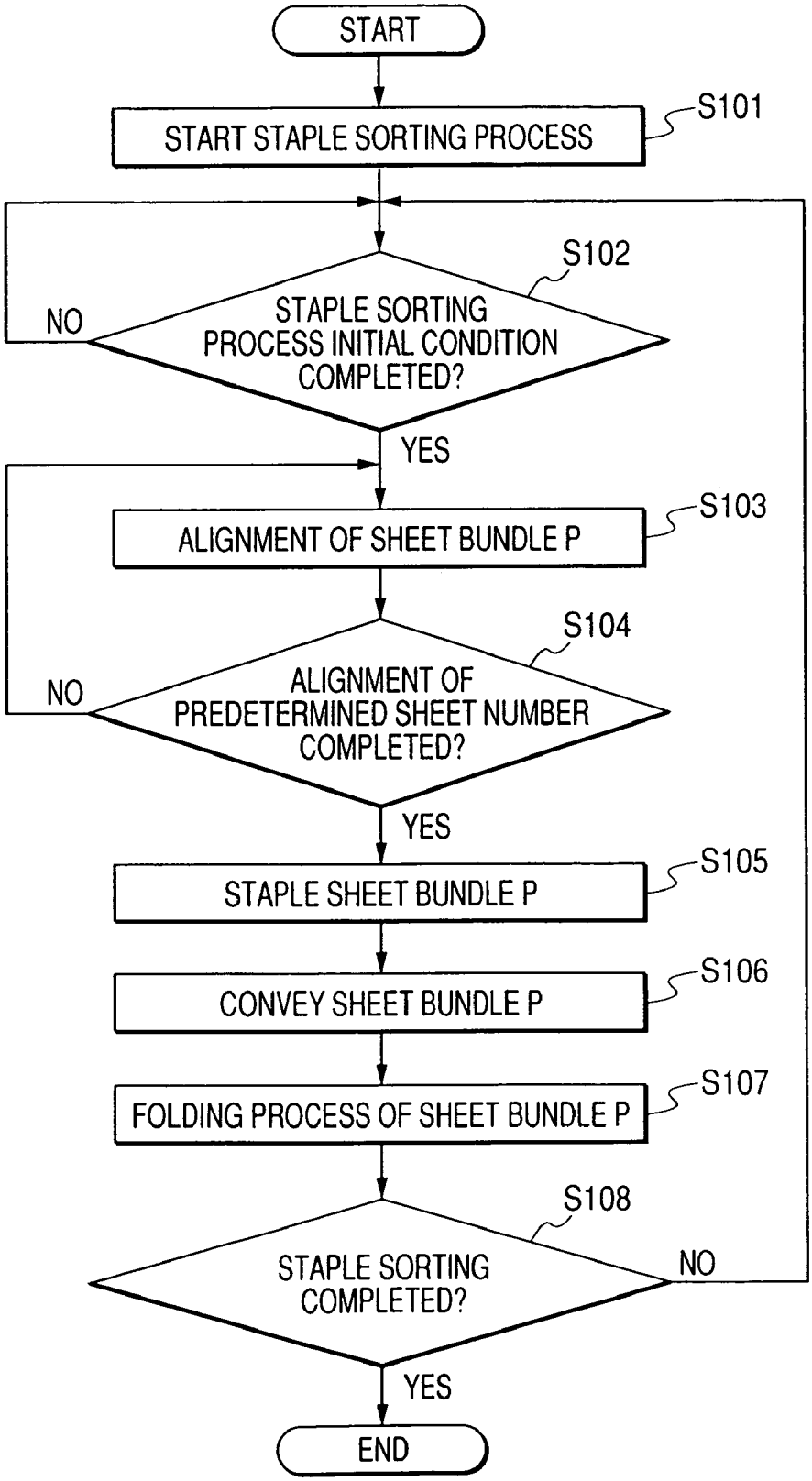
FIG. 6 is a flowchart for illustrating the operation of side stitch binding process.

Through repetition of the above operations, a predetermined number of sheets are stacked on the process tray 40, and a judgment is made as to whether the alignment of a preset number of sheets has been completed or not (FIG. 4B, FIG. 6(S104)), with the trailing edge portion of the sheet stack P being stapled by the end stapler 10 which is a staple sorting stapler (FIG. 6 (S105)). Thereafter, the trailing edge stopper 62 moves by a predetermined distance toward the discharge roller pair 74 to convey the sheet stack in the same direction (FIG. 4C, FIG. 6 (S106)). Further, the conveyance assist roller 50 also rotates for movement of the sheet to a heavy pressure position, and moves the sheet stack toward the discharge roller pair 74.

Figure 5:
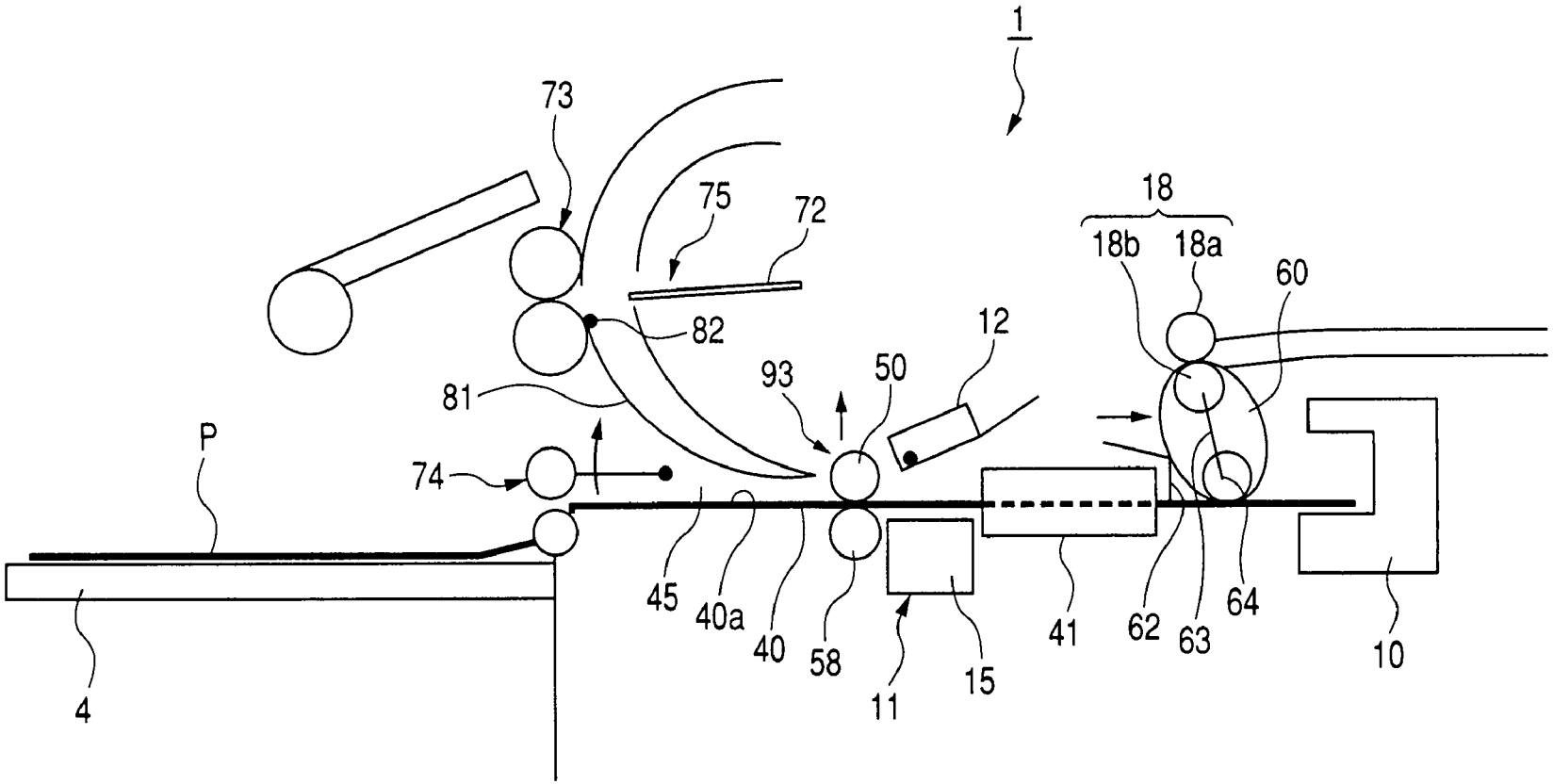
FIG. 5 is a diagram for illustrating the side stitch binding process operation as continued from FIGS. 4A through 4C, showing how the sheet stack with an end portion thereof stapled is discharged onto a stack tray.

Thereafter, the discharge roller pair 74 closes to nip the sheet stack, whereby the sheets are folded and the sheet stack is discharged onto the stack tray 4 (FIG. 5, FIG. 6 (S107). At this time, in order that the discharge of the sheet stack may not be obstructed, an arm 63 is tilted upwardly, and the return belt 60 is raised from the inner side by a return belt pulley 48 to separate it from the sheet stack.

When there are any sheets for the next job, the procedure returns to S102 of FIG. 6. When there is none, the sheet processing apparatus 1 terminates the staple sorting process (FIG. 6 (S108). In the above description, in the case of mere sorting process, the sheet stack is discharged in a state in which the sheet stack is aligned without being stapled by the end stapler 10.

The conveyance assist roller 50 is formed by coating the surface of a foam layer (which consists of sponge in this case) with an elastic layer (which consists of rubber in this case), making it possible not only to effect slippage of the conveyance assist roller 50 with respect to the sheets being pulled, but also to convey the sheet stack toward the discharge roller pair 74, thus aiding the conveyance of the sheet stack by the discharge roller pair 74.

Figure 3C:
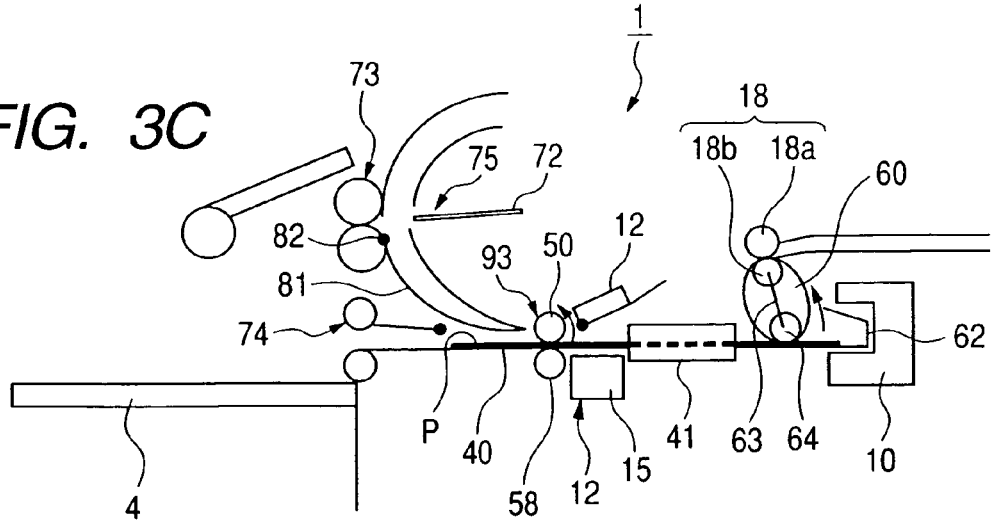
FIG. 3C is a diagram showing how the sheet on the process tray is moved toward a stopper.

Further, the conveyance assist roller 50 rotates counterclockwise as indicated by the arrow in FIG. 3C to convey the sheets to the return belt 60, and then rotates clockwise as indicated by the arrow in FIG. 4A to impart a load to the sheets with respect to the conveyance by the return belt 60; however, it is not always necessary for the roller to rotate clockwise as indicated by the arrow. In a rotatable state, it may be simply brought into contact with the sheets, imparting a load to the sheets with respect to the conveyance by the return belt 60. Alternatively, the counterclockwise conveying speed of the conveyance assist roller 50 is set to be lower than the counterclockwise conveying speed of the return belt 60, and the sheet conveying force (moving force F1) of the conveyance assist roller 50 is set to be less than the sheet conveying force (moving force F2) of the return belt 60 (F1<F2), whereby there is no need to effect clockwise rotation of the conveyance assist roller 50 even when the trailing edges of the sheets P reach the return belt 60.

(Illustration of the Saddle Stitch Process Operation)

Figure 7A:
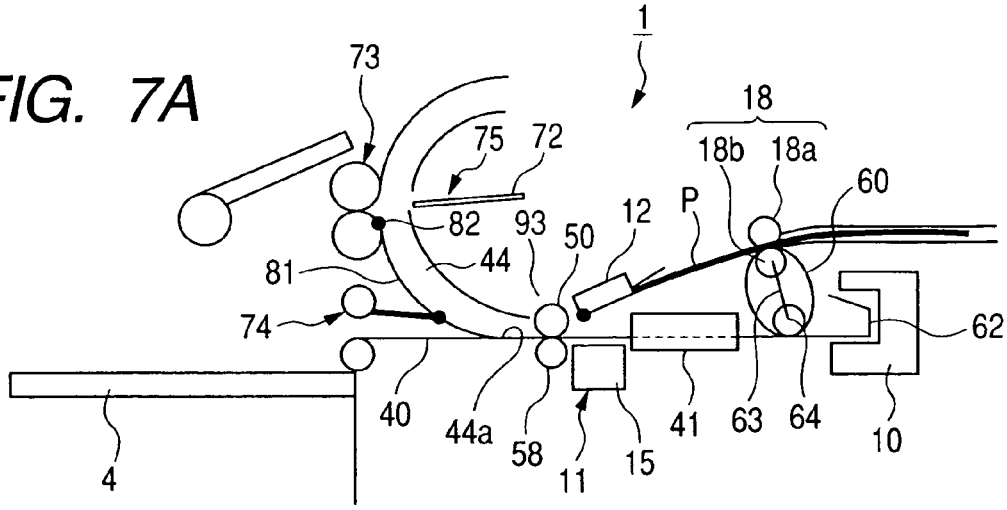
FIG. 7A is a diagram for illustrating the operation of saddle stitch process of the sheet processing apparatus of the embodiment of the present invention, showing how a sheet is conveyed to the sheet processing apparatus.

Next, the operation of saddle stitch process will be described with reference to FIGS. 7A, 7B, 7C, 8A, 8B, 8C, 9A, 9B, 9C and 10 through 12. When a saddle stitch mode is selected, the sheet processing apparatus 1 moves, as shown in FIG. 7A, the anvil 12 of the intermediate stapler (saddle stitch stapler) 11, upwardly, before the sheets P are discharged from the first discharge roller pair 7 of the color copying machine 30, and brings the conveyance assist roller 50 into slight contact with the driven roller 58. Further, the sheet processing apparatus 1 moves the curved outer guide 81 to the lower position so that the sheet stacking surface 40*a* of the process tray 40 may have a curved surface. The curved outer guide 81 rotates around a shaft 82 provided near the sheet folding roller pair 73. Further, the sheet processing apparatus 1 holds the trailing edge stopper 62 for regulating the trailing edges of the sheets on standby at the home position, the staple position for the sorted sheets (FIG. 11 (S201)). Then, a judgment is made as to whether the initial stage of the operation process has been completed. That is, a judgment is made as to whether the anvil 12 is at the raised position, whether the curved guide 81 is at the lowered position, whether the conveyance assist roller 50 is at the light pressure position, whether the discharge roller pair 74 is open, and whether the trailing edge stopper 62 is at a position corresponding to a predetermined sheet size (S202).

Here, depending upon the sheet length, the curved lower guide 81 has sheets stacked thereon, and also serves as a part of the process tray 40. When the curved lower guide 81 is formed as a part of the process tray 40, it is possible to reduce the intrinsic length of the process tray 40 of the sheet processing apparatus 1. Further, the sheet pushing plate 72 of the folding device 75 for folding the sheet stack is arranged on the inner side of the curved path 44 for the purpose of making it possible to receive on the same stack tray 4 the sheet stack discharged from the discharge roller pair 74 and the sheet stack pushed out by the sheet pushing plate 72, folded into two, and discharged from the sheet folding roller pair 73; due to this arrangement, it is possible to reduce the size of the sheet processing apparatus 1.

Figure 7B:
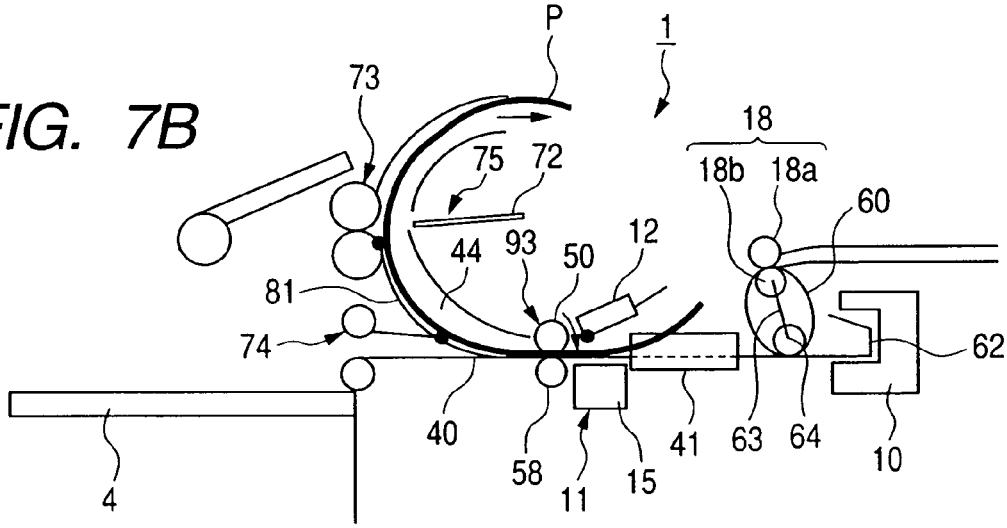
FIG. 7B is a diagram showing how the sheet is sent to the process tray.
Figure 7C:
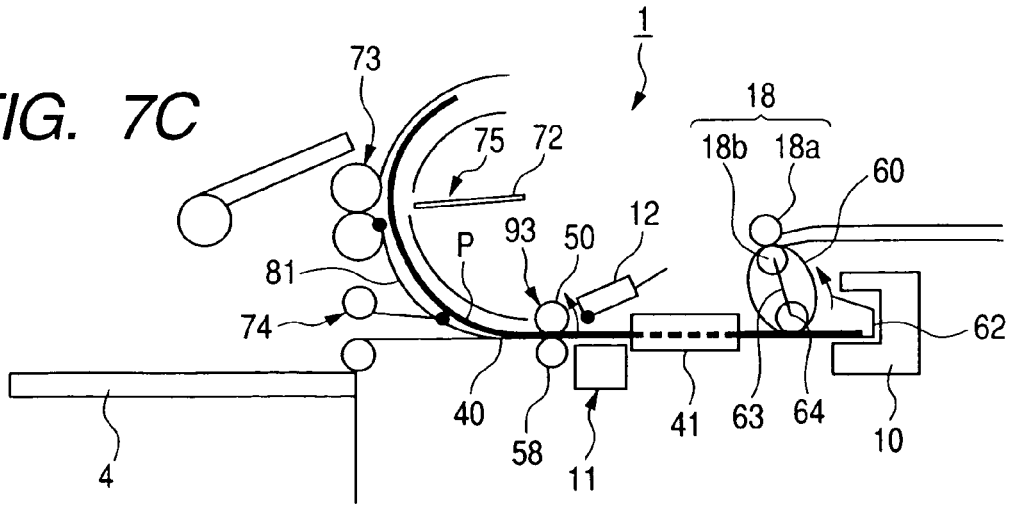
FIG. 7C is a diagram showing how the sheet on the process tray is moved toward the stopper.
Figure 8A:
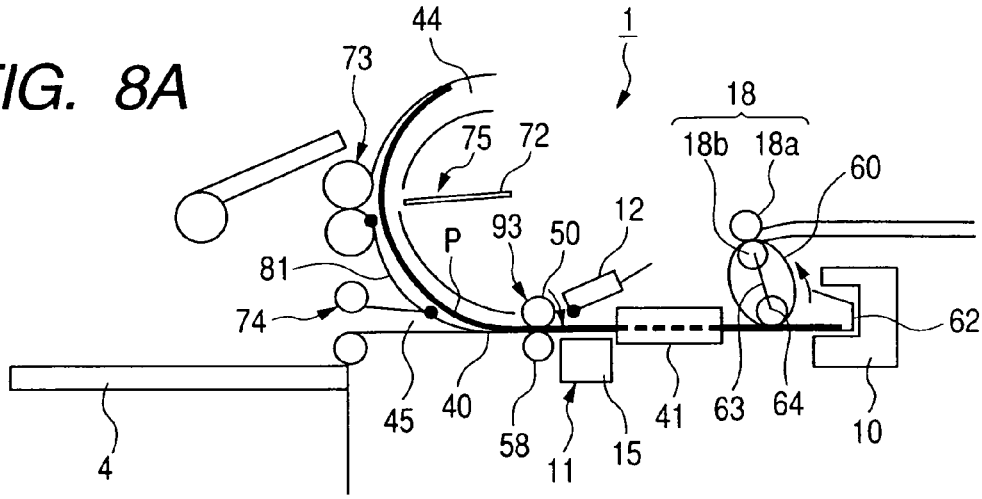
FIG. 8A is a diagram for illustrating the operation of saddle stitch process as continued from FIGS. 7A through 7C, showing how the sheet on the process tray is moved toward the stopper.
Figure 8B:
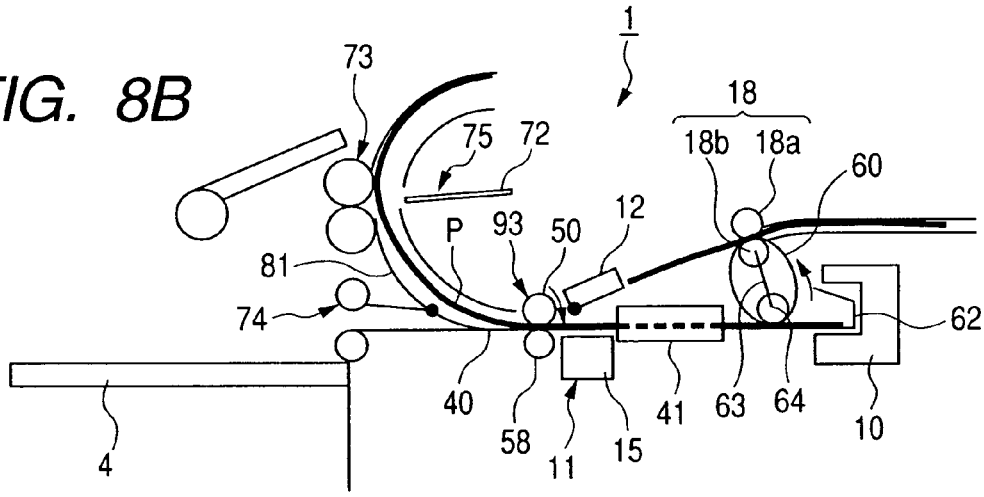
FIG. 8B is a diagram showing how the sheet on the process tray is abutted on the stopper.

As shown in FIG. 7A, the sheets P fed into the sheet processing apparatus 1 are discharged toward the process tray 40 by the sheet discharge roller pair 18. As shown in FIG. 7B, the sheets P to be discharged are guided by the anvil 12 and conveyed by the conveyance assist roller 50 until they are spaced apart downstream from the sheet discharge roller pair 18 by a predetermined distance (for example, approximately 20 mm). Thereafter, the sheet processing apparatus 1 stops the conveyance assist roller 50 and reverses it (rotates it counterclockwise), conveying the sheets P toward the return belt 60. When the trailing edges (the right-hand end in FIGS. 7A, 7B and 7C) of the sheets P reach the return belt 60 (FIG. 7C), the conveyance assist roller 50 starts to rotate clockwise to move the sheets P toward the downstream side (toward the discharge roller pair 74) (FIG. 8A).

As stated above, at this time, the sheet conveying force (moving force F1) of the conveyance assist roller 50 is set to be smaller than the sheet conveying force (moving force F2) of the return belt 60 (F1<F2), so that the return belt 60 moves the sheets to the trailing edge stopper 62 side against the load of the conveyance assist roller 50. Thus, the sheets are pulled away from the trailing edge stopper 62 by the conveyance assist roller 50, and are moved to the trailing edge stopper 62 side by the return belt 60 without involving any slack and abut on the trailing edge stopper 62. As in the case of staple sorting process described above, in the case of saddle stitch process also, there is no need to reverse the conveyance assist roller 50 after the trailing edges of the sheets P have reached the return belt 60; any control operation is acceptable as long as it imparts a load to the conveyance by the return belt 60, for example, stopping its rotation, making it rotatable, or rotating it in the same direction as the return belt 60 at a lower conveying speed.

Figure 10:
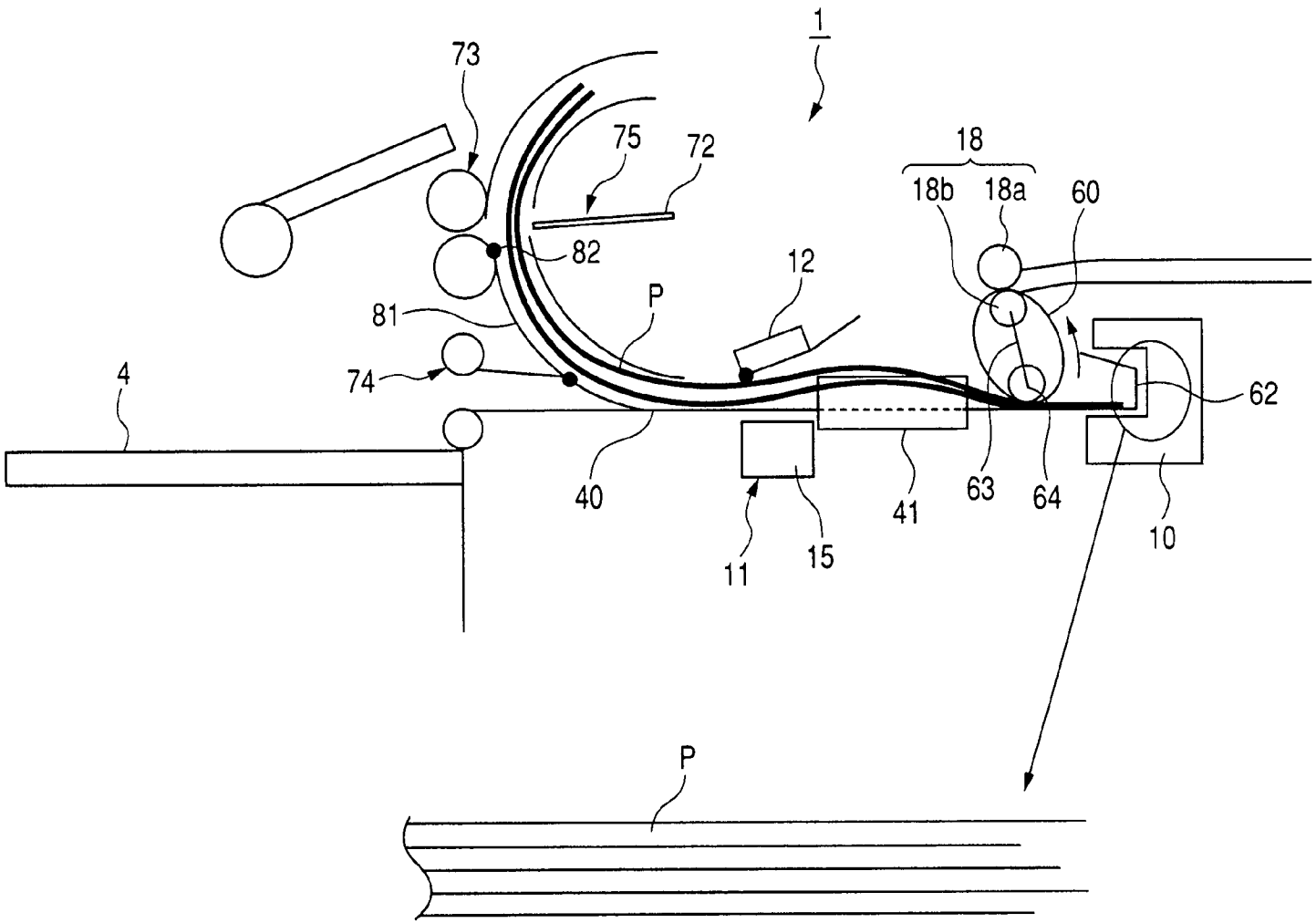
FIG. 10 is a diagram illustrating a problem involved when there is provided no conveyance assist roller as a load imparting means.

The curved outer guide 81 is arranged close to the process tray 40 so that the sheets can be guided to the curved path 44, so that, as shown in FIG. 10, if no conveyance assist roller 50 is provided, the following problem will occur.

That is, when the sheets entering the curved path 44 are of small thickness, there is a fear of the sheets curling and undergoing buckling when entering or after entering to some extent the curved path 44. Conversely, when the sheets are of large thickness, there is a fear of the sheets not being capable of reliably entering the curved path 44. As a result, as shown in FIG. 10, which is an enlarged view of the end portion of a sheet stack, there is a fear of defective alignment of the sheet stack end portion being generated at the time of sheet alignment or deviation of the sheet stack end portion being generated at the time of stapling. When sheets are discharged and stacked on the process tray 40 in an unstable posture, an attempt to align the sheets as they are will result in that posture affecting the end portion alignment at the time of sheet alignment. That is, such sheet condition as curling or buckling will offer resistance to the sheet alignment operation, resulting in variation in sheet moving distance. If, in order to absorb this variation, the moving distance were set to be relatively large, the sheets discharged and stacked on the process tray 40 in a satisfactory posture would move through this moving distance set to be relatively large without meeting any resistance, so that the conveying force would continue to be applied even after the end portion abuts the stopper, which means there is a fear of buckling occurring. While in the sheet processing apparatus 1 of this embodiment the curved path 44 is curved upwardly, a similar problem would be involved even if it were curved downwardly.

The sheet processing apparatus 1 of this embodiment, however, has the conveyance assist roller 50, so that even if buckling occurs in the sheets or the sheets cannot reliably enter the curved path 44, the portions of the sheets situated on the flat sheet stacking surface 40*a* of the process tray 40 between the conveyance assist roller 50 and the return belt 60 are pulled so as to eliminate slack, whereby it is possible to ensure sheet alignment property and to prevent deviation in stapling the sheet stack. Further, the difference between the sheet conveying force of the return belt 60 and the sheet conveying force of the conveyance assist roller 50 is set to such a level as will not involve buckling when the sheets P are pressed against the trailing edge stopper 62. While in the sheet processing apparatus 1 of this embodiment the curved path 44 is upwardly curved, it is also possible to ensure the sheet alignment property and prevent deviation in stapling the sheet stack even when the curved path is downwardly curved.

In the sheet processing apparatus 1, after performing alignment on the end portion crossing the conveying direction for the sheets P, alignment (width alignment) of the side end extending along the conveying direction for the sheet P is effected by a pair of alignment plates 41. That is, in the sheet processing apparatus 1, after performing alignment on the end portion crossing the conveying direction for the sheets P with the sheets abutted on the trailing edge stopper 62 by the return belt 60, alignment (width alignment) on the side end extending along the conveying direction for the sheets P is performed. That is, after conveying the sheets P by a predetermined amount from the discharge roller pair 8, the conveyance assist roller 50 is reversed, and, further, after conveying the sheets P by a predetermined amount from the return belt 60, the conveyance assist roller 50 is caused to make normal rotation, effecting alignment on the sheets P by the pair of alignment plates 41 as the side end alignment means (FIG. 11 (S203)). The pair of alignment plates 41 are operated by a driving means (not shown) (for example, a drive source consisting of rack and pinion gear, and a control means), whereby the alignment property for the sheet side end can be enhanced.

Figure 8C:
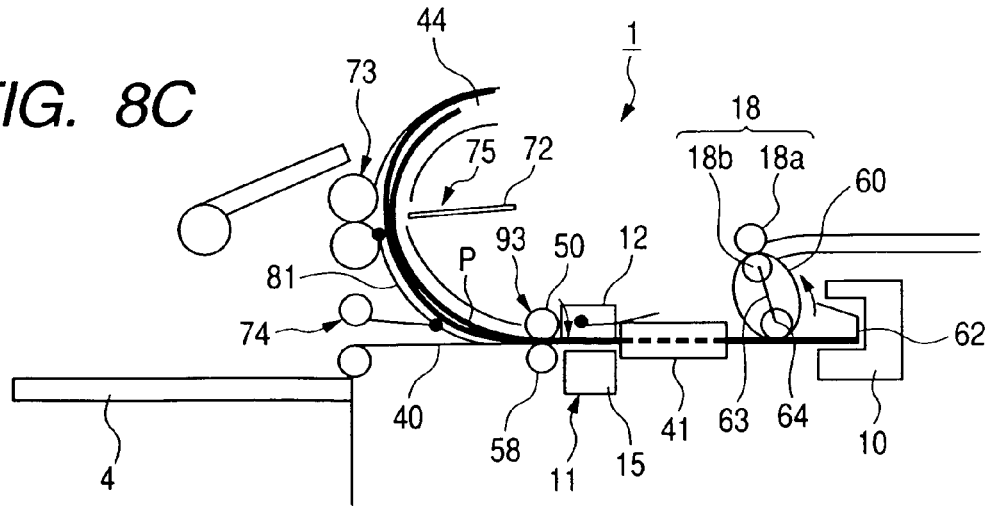
FIG. 8C is a diagram showing how a predetermined number of sheets are stacked on the process tray.
Figure 11:
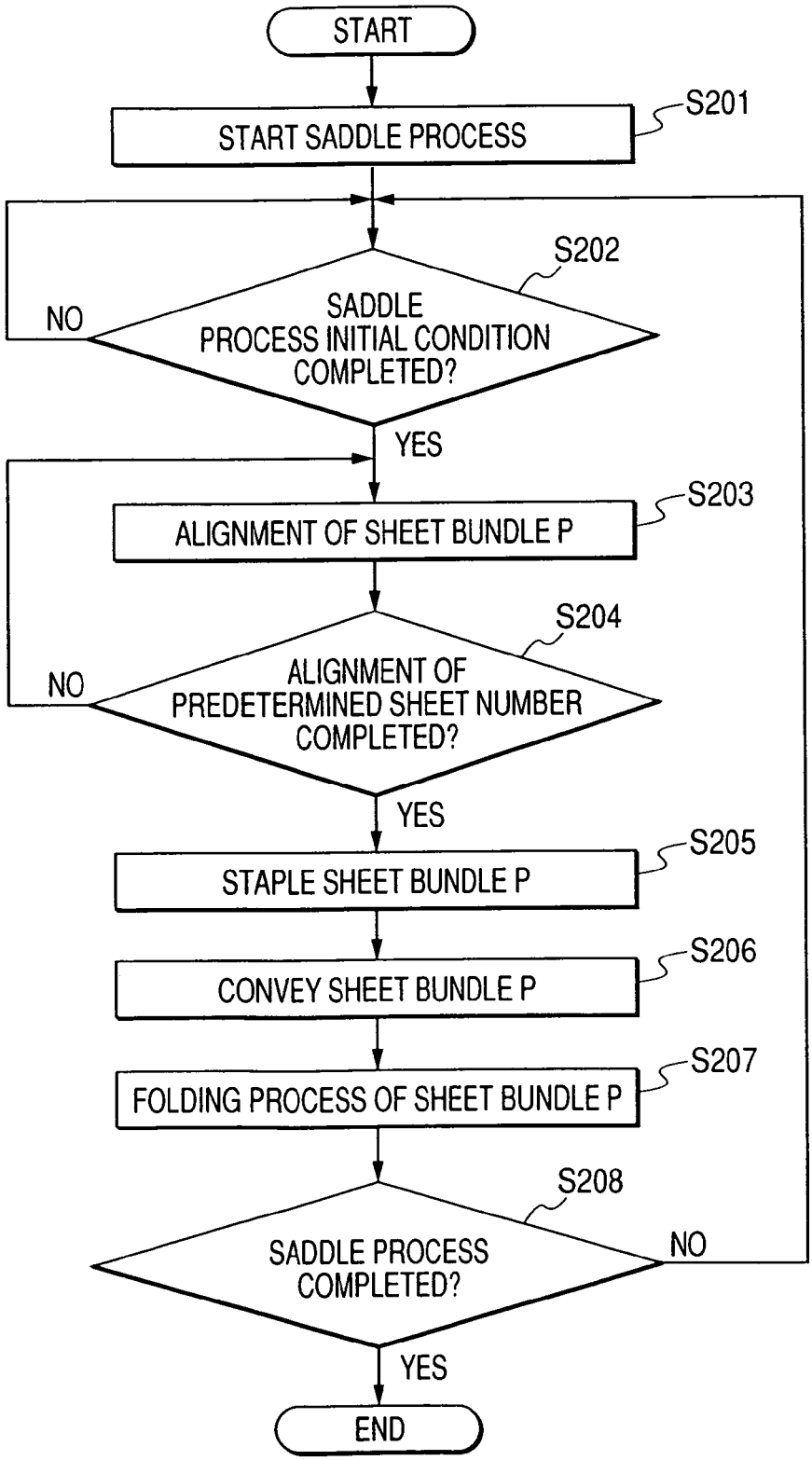
FIG. 11 is a flowchart for illustrating the operation of saddle stitch process.

When, through repetition of the above operations, a predetermined number of sheets have been stacked on the process tray 40, a judgment is then made as to whether the alignment of a preset number of sheets has been completed or not (FIG. 8C, FIG. 11 (S204)), and the anvil 12 is moved to the lowered position, and the driver 15 of the intermediate portion stapler 11, which is a saddle stitch stapler, and the anvil 12 cooperates to staple the central portion of the sheet stack S (FIG. 8C, FIG. 11 (S205)). The central portion of the sheet stack stapled by the intermediate portion stapler 11 is stacked on the flat sheet stacking surface 40*a*, and is pulled by the conveyance assist roller 50 and the return belt 60, so that it is possible to perform stapling with little deviation between the sheets.

Further, the conveyance assist roller 50 is arranged in the vicinity of the boundary between the flat sheet stacking surface 40*a* and the curved path 44, and the intermediate portion stapler 11 is arranged near the return belt 60 side portion of the conveyance assist roller 50, so that the construction in which the curved path 44 is provided to reduced the size of the sheet processing apparatus 1 is utilized to the utmost, making it possible to staple the intermediate portion of the sheet stack even in the case of long sheets.

The stapled sheet stack is pushed toward the curved path 44 by the trailing edge stopper 62 by a driving motor (not shown) so that the staple position of the sheet stack S will be opposed to the nip of the sheet folding roller pair 73 (FIG. 11 (S206)). At this time, the arm 63 is tilted upwards so that it may not obstruct the discharge of the sheet stack, and the return belt 60 is raised from the inner side by the return belt pulley 48 to be separated from the sheet stack. Further, the conveyance assist roller 50 is moved to the heavy pressure portion and is rotated to aid the conveyance of the sheet stack. When the sheet stack S moves to the position where its central stapled portion is pushed by the sheet pushing plate 72, the sheet stack conveyance by the conveyance assist roller 50 and the trailing edge stopper 62 is stopped.

Figure 9A:
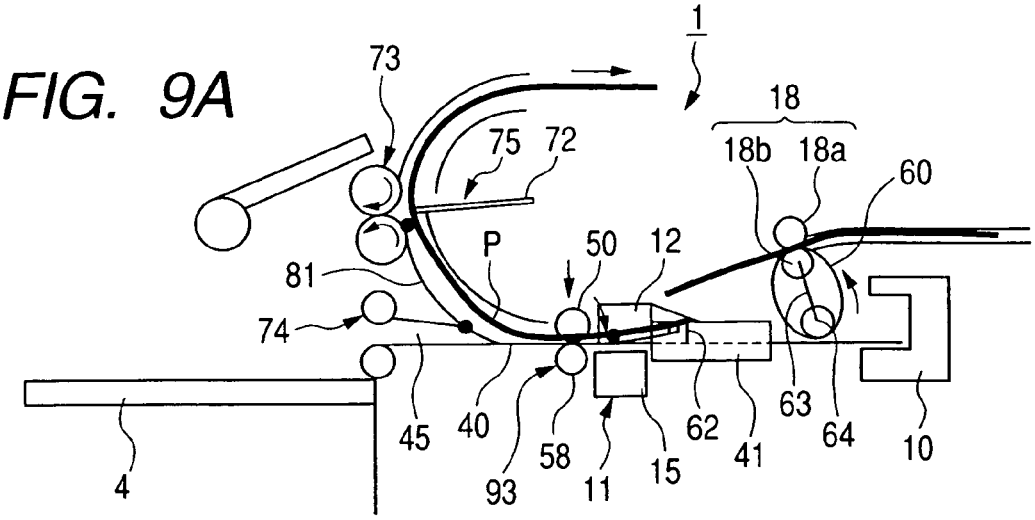
FIG. 9A is a diagram for illustrating the operation of saddle stitch process as continued from FIGS. 8A through 8C, showing how a sheet stack is conveyed to a folding device to start the folding of the sheet stack by the folding device.
Figure 9B:
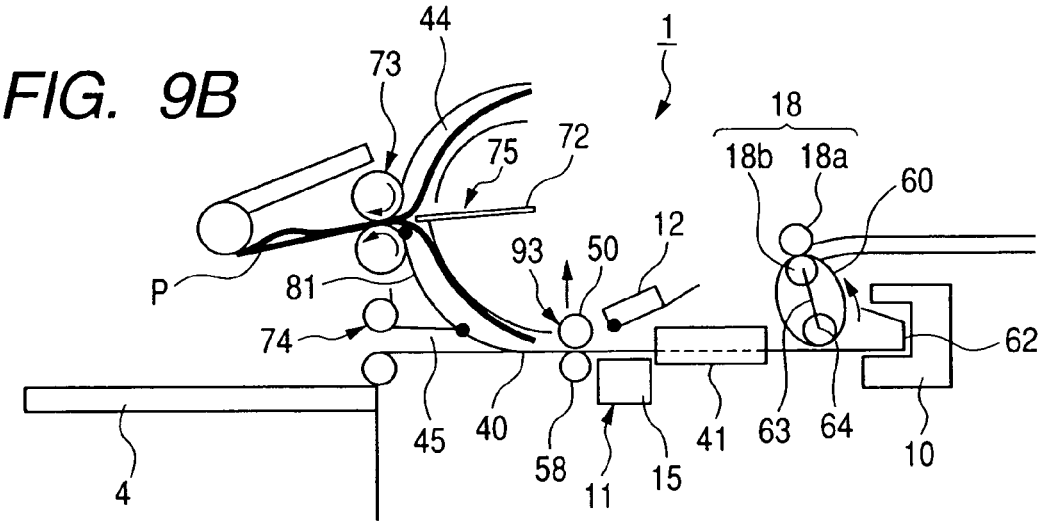
FIG. 9B is a diagram showing how the sheet stack is folded by a sheet folding roller pair of the folding device.
Figure 9C:
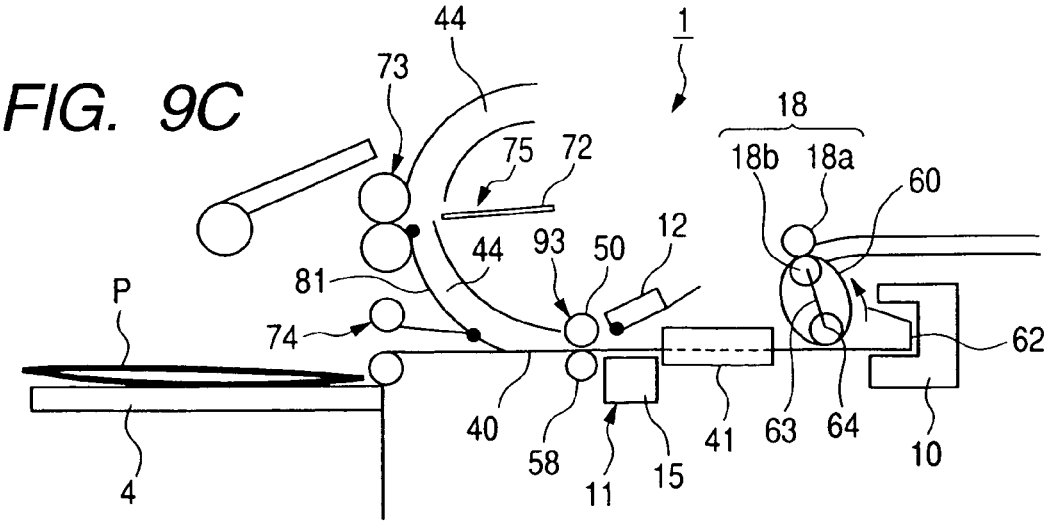
FIG. 9C is a diagram showing how the folded sheet stack is discharged onto the stack tray.

Thereafter, the central stapled portion of the sheet stack S is pushed by the sheet pushing plate 72 (FIG. 9A), and the sheet stack S is pushed into the nip of the sheet folding roller pair 73. The sheet folding roller pair 73 nips and conveys the sheet stack S while folding it into two, and discharge it onto the stack tray 4 (FIG. 9B, FIG. 9C, FIG. 11, S207).

When the sheet stack moves within the curved path 44, the sheet stack is rubbed against the inner wall of the curved path 44 to generate load resistance; this load resistance may be reduced by providing a roller (not shown) on the inner wall of the curved path 44, or allowing the curved outer guide 81 to retract to the discharge roller pair 74 side around the shaft 82.

Further, in the sheet processing apparatus 1 of this embodiment, in order that the return belt 60 and the conveyance assist belt 50 may not be increased in conveying force as the number of stacked sheets increases, it is possible to provide a sheet number counter (not shown), a support roller position driving means (which is a motor in this case), a control means (not shown), etc. whereby the return belt 60 and the conveyance assist roller 50 are raised by a predetermined amount (e.g., approximately 1 mm) for a predetermined number of sheets (e.g., approximately 10 sheets) to thereby keep the sheet conveying force substantially at a fixed level.

The force with which the sheet stack is nipped by the conveyance assist roller 50 and the driven roller 58 may be made adjustable according to the thickness of the sheet stack. This makes it possible to convey the sheet stack reliably.

Figure 12:
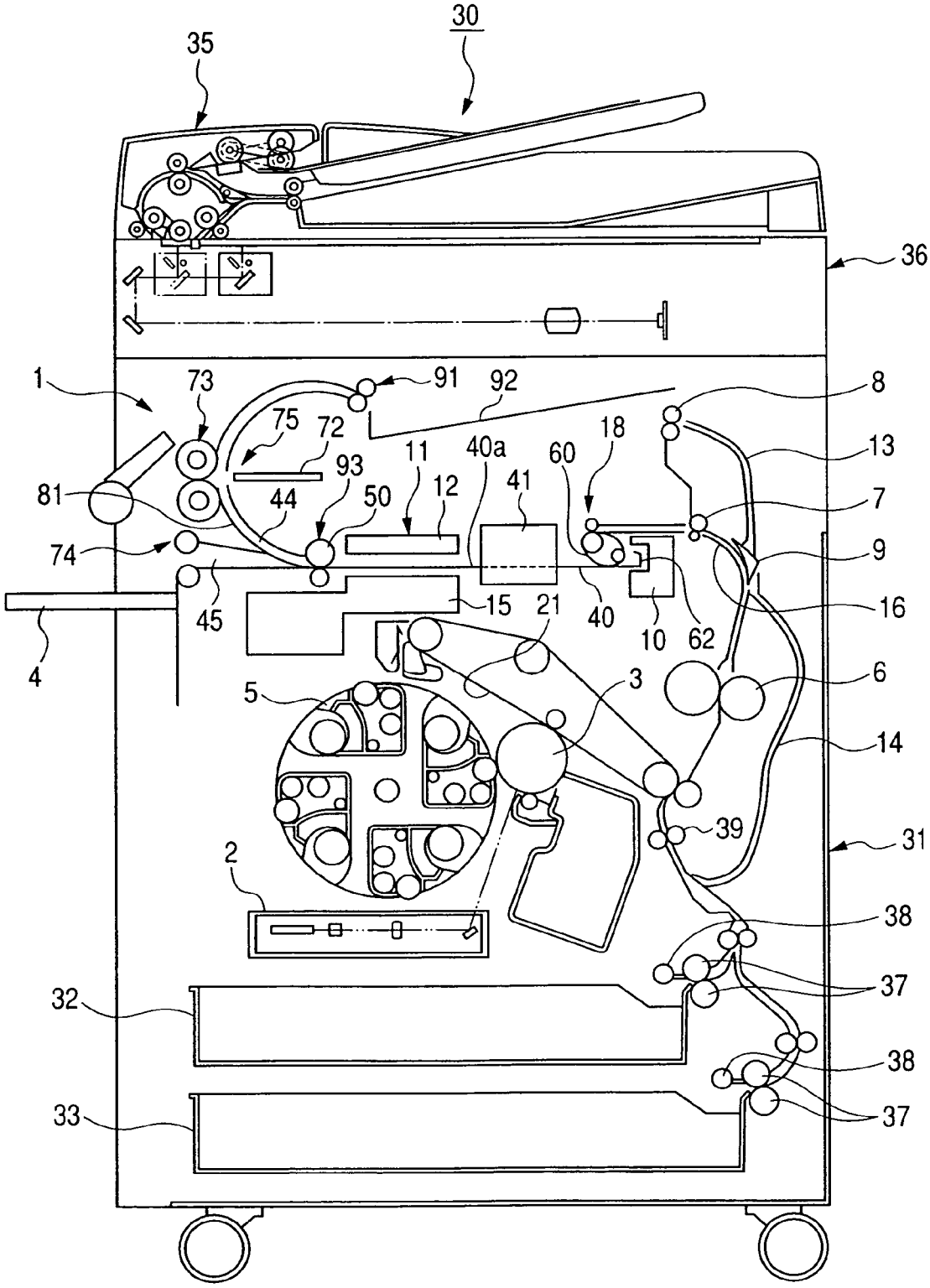
FIG. 12 is a schematic front sectional view of a color copying machine equipped with a sheet processing apparatus according to another embodiment.

The curved outer guide 81 of the above-described sheet processing apparatus 1 is provided for saddle stitch alignment and for the conveyance route for the sheet stack to be folded; it is also possible, as shown in FIG. 12, to provide a discharge roller 91 and an in-apparatus tray 92 in the downstream portion of the curved path 44 to make it possible to discharge the sheet stack onto the in-apparatus tray 92 through the guidance by the curved path 44, thus causing the in-apparatus tray 92 to function as a second stack tray.

In this case, the sheet processing apparatus 1 causes the curved path 44 to support the sheet end portion at the time of staple sorting process to effect alignment of the sheet stack, and the sheet stack is stapled by the stapler 10, and conveyed to the discharge roller 91 by the trailing edge stopper 62 and the conveyance assist roller 50 before being discharged onto the in-apparatus tray 92 by the discharge roller 91.

Figure 13:
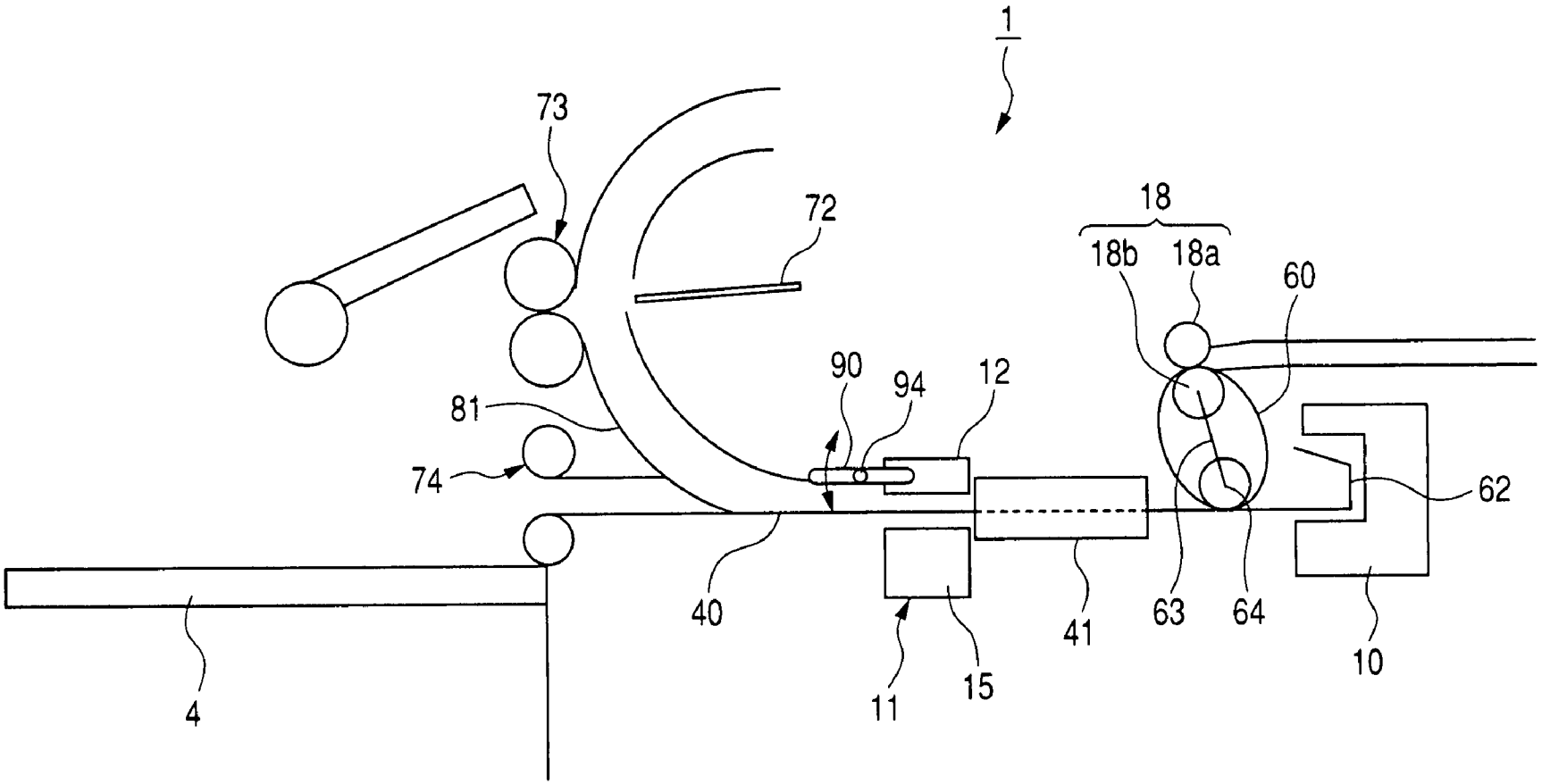
FIG. 13 is a schematic front sectional view of a sheet processing apparatus according to another embodiment.

Further, while the conveyance assist roller 50 of this embodiment has in the outer periphery a foam plastic elastic layer, it is also possible, as shown in FIG. 13, to use a paddle 90 which is formed as an elastic plate of rubber, elastic resin or the like and which is a load imparting means rotatable in the direction of the arrow around a rotation center shaft 94. The operation of the paddle 90 is similar to that of the conveyance assist roller 50.

Figure 14:
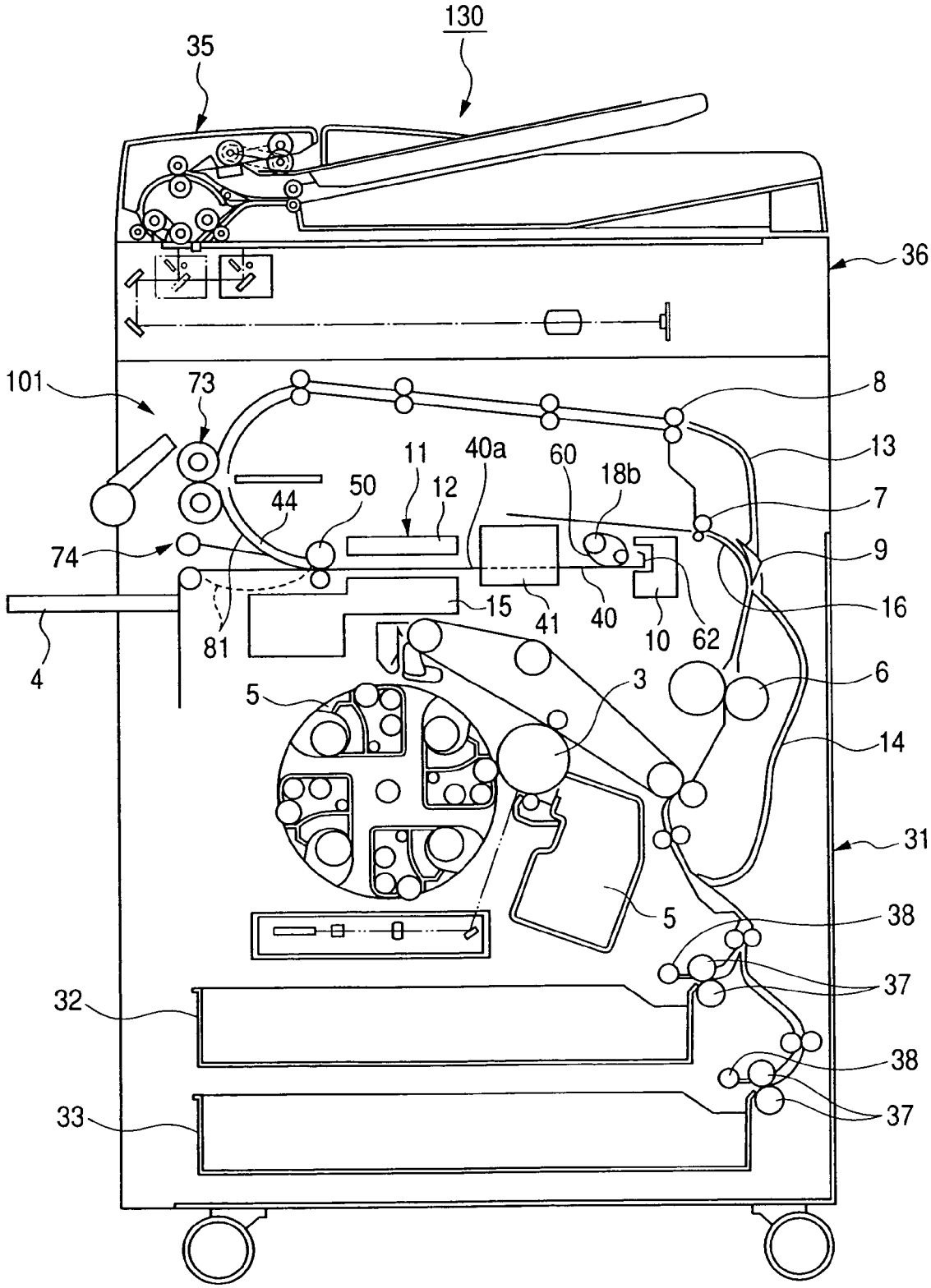
FIG. 14 is a schematic front sectional view of a color copying machine as an image forming apparatus equipped with a sheet processing apparatus according to another embodiment.
Figure 15:
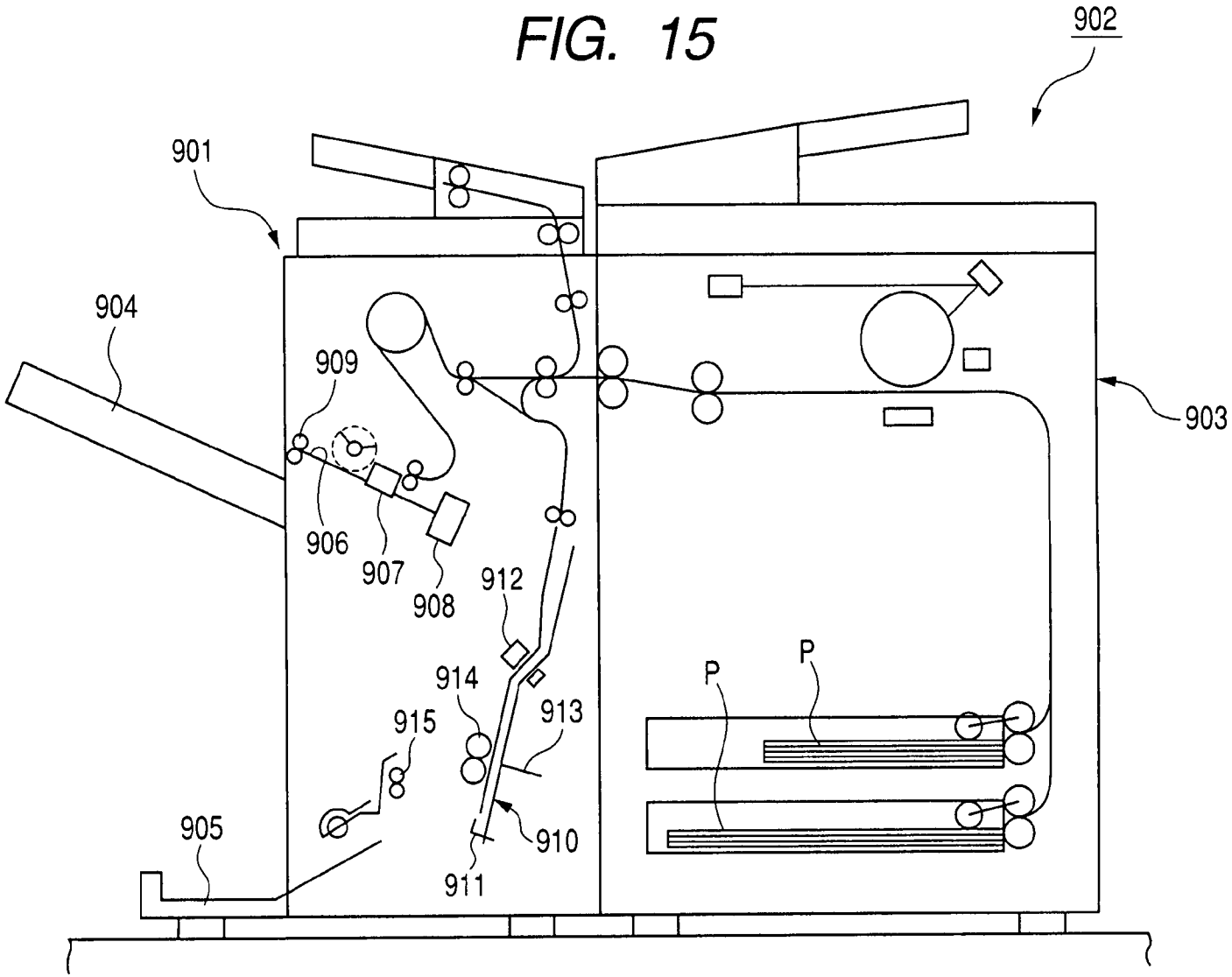
FIG. 15 is a schematic front sectional view of a color copying machine as a conventional image forming apparatus equipped with a conventional sheet processing apparatus.

While the curved outer guide 81 shown in FIGS. 1 through 13 is constructed such that the process tray 40 side end portion thereof rotates around the shaft 82, it is also possible, for example, as in the case of a curved outer guide 181 shown in FIG. 14, to adopt a construction in which the discharge roller pair 74 side end portion thereof rotates vertically around the process tray 40 side end portion thereof.

In the color copying machine 30 of the above embodiment, the sheets are discharged from the first discharge roller pair 7 and undergo sheet process by the sheet processing apparatus 1. Thus, the sheet conveying direction in which the sheets are sent out from the apparatus main body 31 of the color copying machine 30 and conveyed to the sheet processing apparatus and the direction in which the sheets are abutted on the trailing edge stopper 62 are opposite to each other.

In contrast, in the color copying machine 130 shown in FIG. 14, the sheets are discharged from a second discharge roller pair 8 and undergo sheet process by a sheet processing apparatus 101. Thus, in the color copying machine 130, the sheet conveying direction in which the sheets are sent out from the apparatus main body 131 and conveyed to the sheet processing apparatus 101 and the direction in which the sheets are abutted on the trailing edge stopper 62 are the same, so that the alignment of the sheet end portion can be easily effected.

The construction of the color copying machine 130 is substantially the same as that of the color copying machine 30, so that the same portions are indicated by the same reference numerals, and a description of the construction and operation thereof will be omitted. The curved outer guide 181 is constructed such that the discharge roller pair 74 side thereof rotates vertically around the conveyance assist roller 50.

In the apparatus main body 131, the conveying path indicated by numeral 16 constitutes a sheet reversal path when images are to be formed on both sides of a sheet, and the conveying path indicated by numeral 13 constitutes a path for discharging sheets.

The sheets discharged from the second discharge roller pair 8 are conveyed by way of the curved-path 44 and on the process tray 40 by the conveyance assist roller 50 rotating counter clockwise, and are abutted on the trailing edge stopper 62 by the return belt 60. When the sheets are conveyed to the return belt 60, the conveyance assist roller 50 rotates clockwise so that the sheets may not slacken, whereby the alignment property for the sheet end portion is enhanced.

The trailing edges (the left-hand ends in FIG. 14) of the sheets in the curved path 44 or on the process tray 40 are pressed from above by a flapper (not shown) so that a succeeding sheet may not get under the preceding ones, whereby the succeeding sheet passes over the flapper and is stacked on the preceding ones in the order of the pages. When a succeeding sheet is superimposed on the preceding ones, the flapper is temporarily raised, and presses the trailing edge of that succeeding sheet, guiding and superimposing a further succeeding sheet onto the preceding sheet.

In the case of staple sorting process, when a predetermined number of sheets have been stacked on the process tray 40, the end portion of the sheet stack is stapled by the trailing edge stapler 10. Thereafter, the curved outer guide 81 rotates downwardly as indicated by a broken line. The sheet stack is discharged onto the stack tray 4 by the conveyance assist roller 50 and the discharge roller pair 74.

In the case of saddle stitch process, when a predetermined number of sheets have been stacked on the process tray 40, the intermediate portion of the sheet stack is stapled by the intermediate portion stapler 11. Thereafter, the sheet stack is guided to the folding device 75 by the curved path 44. Finally, the sheet stack is folded into a booklet by the folding device 75, and discharged onto the stack tray 4.

This application claims priority from Japanese Patent Application No. 2004-211808 filed on Jul. 20, 2004, which is hereby incorporated by reference herein.

What is claimed is:

1. A sheet processing apparatus comprising:

a stacking portion which receives and stacks a sheet that is conveyed;

a moving unit which moves the sheet conveyed to said stacking portion;

a stopper which receives an end portion of the sheet moved by said moving unit; and a load imparting portion which comes into contact with an upper surface of the sheet on the upstream side of said moving unit with respect to the sheet moving direction and imparts a load to the movement of the sheet a stapler which staples the sheets stacked on the sheet stacking surface, wherein the stapler is an intermediate portion stapler which staples an intermediate portion of the sheets between the moving unit and the load imparting portion;

a curved guide path which guides the sheet in a curved manner and which is provided on the upstream side of the stacking portion with respect to the direction in which the sheet is moved by the moving unit; and a folding device which folds the sheets stapled by the intermediate portion stapler in the curved guide path, wherein said moving unit moves the sheet to the stopper while the sheet is pulled by the load imparted by said load imparting portion, wherein the stacking portion has a flat sheet stacking surface, wherein said moving unit is arranged in the vicinity of the sheet stacking surface, and wherein the folding device comprises a pushing member extending through the curved guide path from the inner side to the outer side of a curved portion to push the sheets, and a folding portion which is pushed by the pushing member and receives and folds the sheets.

2. A sheet processing apparatus according to claim 1, further comprising a curved guide path which guides the sheet in a curved manner and which is provided on the upstream side of the stacking portion with respect to the direction in which the sheet is moved by said moving unit.

3. A sheet processing apparatus according to claim 1, wherein said load imparting portion is arranged in the vicinity of an upstream side end portion of the sheet stacking surface with respect to the sheet moving direction of the moving unit.

4. A sheet processing apparatus according to claim 1, further comprising a stapler which staples the sheets stacked on the sheet stacking surface, wherein the stapler is an end portion stapler which staples an end portion of the sheets on the downstream side of the moving unit with respect to the sheet moving direction.

5. A sheet processing apparatus according to claim 1, wherein said load imparting portion is capable of temporarily moving the sheet conveyed to the stacking portion in the direction in which the sheet has been conveyed, then moving the sheet toward the moving unit, and thereafter moving the sheet again in the direction in which the sheet has been conveyed.

6. A sheet processing apparatus according to claim 1, wherein said moving unit moves the sheet to said stopper while the sheet is pulled by the load imparted by said load imparting portion.

7. A sheet processing apparatus according to claim 6, wherein the sheet moving force of said load imparting portion is set to be smaller than the sheet moving force of said moving unit.

8. An image forming apparatus comprising:

an image forming portion which forms an image on a sheet; and a sheet processing apparatus which performs a processing on the sheets on which the images have been formed, said sheet processing apparatus comprising:

a stacking portion which receives and stacks the sheet that is conveyed;

a moving unit which moves the sheet conveyed to the stacking portion;

a stopper which receives an end portion of the sheet moved by the moving unit;

a load imparting portion which comes into contact with an upper surface of the sheet on the upstream side of the moving unit with respect to the sheet moving direction and imparts a load to the movement of the sheet, a stapler which staples the sheets stacked on the sheet stacking surface, wherein the stapler is an intermediate portion stapler which staples an intermediate portion of the sheets between the moving unit and the load imparting portion;

a curved guide path which guides the sheet in a curved manner and which is provided on the upstream side of said stacking portion with respect to the direction in which the sheet is moved by the moving unit; and a folding device which folds the sheets stapled by the intermediate portion stapler in the curved guide path, wherein said moving unit moves the sheet to the stopper while the sheet is pulled by the load imparted by said load imparting portion, wherein said stacking portion has a flat sheet stacking surface, wherein said moving unit is arranged in the vicinity of the sheet stacking surface, and wherein said folding device comprises a pushing member extending through the curved guide path from the inner side to the outer side of a curved portion to push the sheets, and a folding portion which is pushed by the pushing member and receives and folds the sheets.

9. An image forming apparatus according to claim 8, further comprising a curved guide path which guides the sheet in a curved manner and which is provided on the upstream side of the stacking portion with respect to the direction in which the sheet is moved by said moving unit.

10. An image forming apparatus according to claim 8, wherein said sheet processing apparatus is provided in an upper portion of the image forming portion.

11. An image forming apparatus according to claim 10, further comprising a reading device which reads an image of an original and which is provided in an upper portion of the sheet processing apparatus.

12. An image forming apparatus according to claim 8:

wherein the moving unit moves the sheet to the stopper while the sheet is pulled by the load imparted by the load imparting portion.

13. An image forming apparatus according to claim 12, wherein the sheet moving force of said load imparting portion is set to be smaller than the sheet moving force of the moving unit.

* * * * *